US007672635B2

(12) United States Patent
Hozumi et al.

(10) Patent No.: US 7,672,635 B2
(45) **Date of Patent: *Mar. 2, 2010**

(54) METHOD AND APPARATUS FOR IMAGE FORMING AND EFFECTIVELY APPLYING LUBRICANT TO AN IMAGE BEARING MEMBER

(75) Inventors: Yoshiki Hozumi, Kanagawa (JP); Toshio Koike, Kanagawa (JP); Ken Amemiya, Tokyo (JP); Masanori Kawasumi, Kanagawa (JP); Yuji Arai, Kanagawa (JP); Tokuya Ojimi, Kanagawa (JP); Takuzi Yoneda, Tokyo (JP); Masami Tomita, Shizuoka (JP); Hiroshi Ono, Tokyo (JP); Takatsugu Fujishiro, Tokyo (JP); Haruji Mizuishi, Tokyo (JP)

(73) Assignee: Ricoh Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/051,880

(22) Filed: Mar. 20, 2008

(65) Prior Publication Data

US 2008/0175635 A1 Jul. 24, 2008

Related U.S. Application Data

(62) Division of application No. 11/315,164, filed on Dec. 23, 2005, now Pat. No. 7,373,101.

(30) Foreign Application Priority Data

Dec. 28, 2004 (JP) ..... 2004-381734
Jan. 25, 2005 (JP) ..... 2005-016620

(51) Int. Cl.
*G03G 21/00* (2006.01)

(52) U.S. Cl. ..... 399/346

(58) Field of Classification Search ..... 399/71, 399/343, 346, 347, 350, 352, 353; 15/1.51, 15/256.5, 256.51
See application file for complete search history.

(56) References Cited

U.S. PATENT DOCUMENTS 6,060,205 A 5/2000 Takeichi et al.

(Continued)

FOREIGN PATENT DOCUMENTS

JP 3521107 9/1998

(Continued)

OTHER PUBLICATIONS

U.S. Appl. No. 12/253,538, filed Oct. 17, 2008, Uno, et al.

*Primary Examiner*—Hoan H Tran
(74) *Attorney, Agent, or Firm*—Oblon, Spivak, McClelland, Maier & Neustadt, L.L.P.

(57) ABSTRACT

A lubricant supplying device including a molded lubricant having a Martens hardness of about 40 N/mm$^2$ to about 70 N/mm$^2$ measured with a test force of 50 mN and a load-applying period of 30 seconds, a rotative member including a fibrous brush of a thickness of about 5 deniers to about 15 deniers in a circumference of a rotative supporting axis of the rotative member with a density of about 20,000 fibers to about 100,000 fibers per square inch, and configured to apply lubricant shavings of the molded lubricant to an image bearing member held in contact with a cleaning member and to remove the lubricant shavings remaining on the surface of the image bearing member, and a pressing member configured to press the molded lubricant against the rotative member at a pressure force ranging from about 2 N/m to about 12 N/m.

18 Claims, 6 Drawing Sheets

U.S. PATENT DOCUMENTS

| | | | | |
|---|---|---|---|---|
| 6,160,977 | A | 12/2000 | Takeichi et al. | |
| 6,363,237 | B1 | 3/2002 | Nagame et al. | |
| 6,807,390 | B2 | 10/2004 | Suda et al. | |
| 7,149,465 | B2 | 12/2006 | Amemiya et al. | |
| 7,209,698 | B2 | 4/2007 | Tawada et al. | |
| 7,292,816 | B2 | 11/2007 | Ojimi et al. | |
| 7,333,744 | B2 * | 2/2008 | Shimojo et al. | 399/71 |
| 2005/0074264 | A1 | 4/2005 | Amemiya et al. | |
| 2005/0084271 | A1 | 4/2005 | Koike et al. | |
| 2005/0164108 | A1 | 7/2005 | Murakami et al. | |
| 2005/0191081 | A1 | 9/2005 | Muraishi et al. | |
| 2005/0191574 | A1 | 9/2005 | Koike et al. | |
| 2005/0232665 | A1 | 10/2005 | Toshio et al. | |
| 2005/0232666 | A1 | 10/2005 | Ojimi et al. | |

FOREIGN PATENT DOCUMENTS

| | | |
|---|---|---|
| JP | 2001-305907 | 11/2001 |
| JP | 2002-287567 | 10/2002 |

* cited by examiner

METHOD AND APPARATUS FOR IMAGE FORMING AND EFFECTIVELY APPLYING LUBRICANT TO AN IMAGE BEARING MEMBER

CROSS REFERENCE TO RELATED APPLICATIONS

The present application is a division of U.S. application Ser. No. 11/315,164 filed on Dec. 23, 2005 and claims priority to Japanese patent application no. 2004-381734, filed in the Japan Patent Office on Dec. 28, 2004, and Japanese patent application no. 2005-016620, filed in the Japan Patent Office on Jan. 25, 2005, the disclosures of which are incorporated by reference herein in their entirety.

BACKGROUND OF THE INVENTION

1. Field of the Invention

The present invention relates to a method and apparatus for image forming and effectively applying lubricant to an image bearing member. More specifically, the present invention relates to a lubricant supplying device that can effectively apply lubricant, an image forming apparatus using a method of electrophotography, electrostatic recording, and electrostatic printing, and including the lubricant supplying device, and a process cartridge included in the image forming apparatus.

2. Discussion of the Related Art

Recently, there has been a strong demand for image forming apparatuses using an electrostatic copying method having a higher productivity of images. While means and methods for obtaining higher productivity of images is studied, toner is also being studied to obtain increased sphericity and smaller particle diameter in order to form high definition images. As toner prepared by pulverizing methods are limited with regard to these properties, polymerized toner prepared by suspension polymerizing methods, emulsification polymerizing methods, and dispersion polymerizing methods for conglobating the toner and making toner having a small particle diameter are being used.

Toner of this nature having a substantially spherical shape, however, have poor cleaning ability. Background image forming apparatuses have used a cleaning device with a cleaning blade for removing toner produced using a pulverizing method. The cleaning blade is held in contact with a surface of a photoconductive element that serves as an image bearing member so that the cleaning blade can scrape toner remaining on the surface of the photoconductive element. However, the cleaning blade cannot stop small toner having a substantially spherical shape from falling through a space between the image bearing member and the cleaning blade into the interior of the image forming apparatus. To remove the toner having the substantial spherical shape, lubricant is applied to a surface of the image bearing member to reduce a coefficient of friction of the image bearing member so that the friction between the image bearing member and the toner is reduced, resulting in easy removal of the toner from the surface of the image bearing member.

To contact the cleaning blade with the surface of the photoconductive element, a predetermined amount of pressure is applied to the cleaning blade. When the pressure is applied for a long period, toner, external additives of toner, and/or hazardous products such as Nox can cause adhesion (or filming) to the surface of the image bearing member, resulting in an image defect such as image deletion. To avoid the above-described condition, the coefficient of friction of the image bearing member is sufficiently reduced, and it is result effective that a lubricant is applied onto the surface of the image bearing member.

A charging device of a background image forming apparatus charges the image bearing member employing a charging method such as a corotron or scrotron method using corona, for example, which is referred to as a corona discharge method. Recently, however, a charging method, in which a charging roller is held in contact with the image bearing member or is disposed in a vicinity of the image bearing member, has been increasingly used in view of environmental circumstances. In the charging method with the charging roller held in contact with the image bearing member or disposed in a vicinity of the image bearing member, a direct-current voltage superimposed with an alternating-current voltage is applied to obtain better uniform charging ability. The direct-current voltage, however, can produce a rough surface on the image bearing member. This tends to increase a coefficient of friction of the image bearing member, which can make the above-described problem more pronounced. According to the above-described circumstances, it is more important that when an image forming apparatus has a charging device to charge the surface of an image bearing member with a direct-current voltage superimposed with an alternating-current voltage, a lubricant is applied to the surface of the image bearing member so that the coefficient of friction can be reduced.

A commonly known lubricant supplying device uses a molded lubricant that includes zinc stearate in a solid form and a brush roller that simultaneously contacts the molded lubricant and the photoconductive element and rotates in a predetermined direction.

A technique has been proposed where a brush roller serves as a lubricant supplying device. In the technique, the brush roller includes a fibrous brush of a thickness of approximately 7.5 deniers to approximately 15 deniers in a circumference of its rotative supporting axis with a density of approximately 20,000 fibers to approximately 60,000 fibers per square inch. The molded lubricant used in the lubricant supplying device has a hardness of pencil such as "H" for "hard", "F" for "firm", "B" for "black", and "HB" for "hard black" and is held in contact with the brush roller at a pressure equal to or less than 1.18 N/m. The lubricant supplying device is used to minimize the consumption of the molded lubricant, is provided in a simple mechanism, and maintains lubrication for a long period of time.

In recent years, inorganic fine particles have been added externally to toner to improve cleaning ability. The inorganic fine particles, however, can adhere to the surface of the image bearing member, cause a filming, and result in an image defect. As previously described, in order to prevent the filming, it is effective to apply the lubricant made of zinc stearate onto the surface of the image bearing member. When a new unit of an image bearing member is used, a new lubricant is also provided and the surface of the lubricant is covered with a skin layer. In this condition, the brush roller cannot easily scrape the molded lubricant, and the amount of the molded lubricant to be supplied becomes low, which can cause the filming. Increasing the amount of pressure applied by the molded lubricant on the brush roller can solve the above-described problem, and can supply a predetermined amount of the molded lubricant. As time passes on, however, the amount of the molded lubricant supplied becomes excessive, which can cause contamination of a charging roller, clogging of used toner due to its low flowability, reduction of the lifespan of the molded lubricant, and so on.

Another technique has been proposed where a lubricant supplying device maintains a coefficient of friction "μ" at a predetermined value by applying a solid lubricant onto a surface of an image bearing member. However, such a technique cannot eliminate the problem described above.

As described above, applying a lubricant onto a surface of an image bearing member and reducing the coefficient of friction of the image bearing member can maintain good cleaning availability and sharply reduce a chance of filming. However, an excessive amount of the lubricant can cause an image defect and a short life of the image forming apparatus. When the molded lubricant is too hard, an extra force for the brush roller to scrape the molded lubricant is required. When the force to be exerted to scrape the molded lubricant is increased, the force is likely to break the molded lubricant and/or make the fibers of the fibrous brush tilt. Consequently, an appropriate lubrication may not be applied and cause an image defect.

When a simple compressed spring is used as a pressuring member, a spring constant increases, which can cause a difference between the initial value and the aged value. This may vary the amount of lubricant due to aging.

When the molded lubricant is too soft, the molded lubricant can break during machine operation, manufacturing process, secondary fabrication, and/or transportation. Further, the amount of lubricant is likely to become greater.

SUMMARY OF THE INVENTION

The present invention has been made in view of the above-described circumstances.

An object of the present invention is to provide a novel lubricant supplying device that can stably apply a lubricant for a long period of time.

Another object of the present invention is to provide a novel method of image forming using the above-described lubricant supplying device.

Another object of the present invention is to provide a novel process cartridge including the above-described novel lubricant supplying device.

Another object of the present invention is to provide an image forming apparatus including the lubricant supplying device which can be provided in the above-described process cartridge.

In one embodiment, a novel lubricant supplying device includes a molded lubricant having a Martens hardness of approximately 40 N/mm$^2$ to approximately 70 N/mm$^2$ measured with a test force of 50 mN and a load-applying period of 30 seconds, a rotative member including a fibrous brush with a thickness of approximately 5 deniers to approximately 15 deniers in a circumference of a rotative supporting axis of the rotative member with a density of approximately 20,000 fibers to approximately 100,000 fibers per square inch, and configured to apply lubricant shavings of the molded lubricant to an image bearing member held in contact with a cleaning member, and remove the lubricant shavings remaining on the surface of the image bearing member. The lubricant supplying device further includes a pressing member configured to press contact the molded lubricant with the rotative member at a pressure force ranging from approximately 2 N/m to approximately 12 N/m.

The rotative member may include a polyester material.

The rotative member may include an insulative material.

A ratio of a circumferential velocity of the rotative member relative to the image bearing member may range from approximately 0.8 to approximately 1.2.

A contact portion of the molded lubricant and the rotative member may include a corner portion of the molded lubricant.

The above-described novel lubricant supplying device may include silica having an average diameter of a primary particle ranging from approximately 80 nm to approximately 300 nm.

A surface of the molded lubricant at the contact portion with respect to the rotative member is configured to be cut off before the molded lubricant may be mounted on the lubricant supplying device.

Further, in one embodiment, a method of image forming includes pressing a molded lubricant having a Martens hardness of approximately 40 N/mm$^2$ to approximately 70 N/mm$^2$ measured with a test force of 50 mN and a load-applying period of 30 seconds to contact with a rotative member at a pressure force in a range from approximately 2 N/m to approximately 12 N/m, applying lubricant shavings of the molded lubricant to an image bearing member held in contact with a cleaning blade, and removing the lubricant shavings remaining on the image bearing member.

The above-described novel method may further include cutting a surface of the molded lubricant at a contact portion with respect to the rotative member before the molded lubricant is mounted on a lubricant supplying device.

Further, in one embodiment, a novel process cartridge detachably attached with respect to an image forming apparatus includes an image bearing member configured to bear an image, a cleaning device configured to clean a surface of the image bearing member, and a lubricant supplying device that includes a molded lubricant having a Martens hardness of approximately 40 N/mm$^2$ to approximately 70 N/mm$^2$ measured with a test force of 50 mN and a load-applying period of 30 seconds, a rotative member having a fibrous brush of a thickness of approximately 5 deniers to approximately 15 deniers in a circumference of a rotative supporting axis of the rotative member with a density of approximately 20,000 fibers to approximately 100,000 fibers per square inch, and configured to apply lubricant shavings of the molded lubricant to an image bearing member held in contact with a cleaning member, and remove the lubricant shavings remaining on the surface of the image bearing member. The lubricant supplying device further includes a pressing member configured to press contact the molded lubricant with the rotative member at a pressure force ranging from approximately 2 N/m to approximately 12 N/m.

Further, in one embodiment, a novel image forming apparatus includes an image bearing member configured to bear an image, a cleaning device configured to clean a surface of the image bearing member, and a lubricant supplying device that includes a molded lubricant having a Martens hardness of approximately 40 N/mm$^2$ to approximately 70 N/mm$^2$ measured with a test force of 50 mN and a load-applying period of 30 seconds, a rotative member having a fibrous brush of a thickness of approximately 5 deniers to approximately 15 deniers in a circumference of a rotative supporting axis of the rotative member with a density of approximately 20,000 fibers to approximately 100,000 fibers per square inch, and configured to apply lubricant shavings of the molded lubricant to the image bearing member held in contact with the cleaning member, and remove the lubricant shavings remaining on the surface of the image bearing member. The lubricant supplying device further includes a pressing member configured to press contact the molded lubricant with the rotative member at a pressure force ranging from approximately 2 N/m to approximately 12 N/m.

The image bearing member, the cleaning device, and the lubricant supplying device may integrally be assembled in a process cartridge.

The above-described novel image forming apparatus may be configured to use toner having an average circularity from approximately 0.93 to approximately 1.00.

The above-described novel image forming apparatus may have a coefficient of friction lesser than or equal to 0.3.

The above-described novel image forming apparatus may be configured to use toner having a volume-based average particle diameter less than or equal to 10 μm and a distribution from approximately 1.00 to approximately 1.40. The distribution may be defined by a ratio of the volume-based average particle diameter to a number-based average diameter.

The above-described novel image forming apparatus may be configured to use toner having a volume-based average particle diameter from approximately 3 μm to approximately 8 μm.

The above-described novel image forming apparatus may be configured to use toner having a shape factor "SF-1" in a range from approximately 100 to approximately 180, and a shape factor "SF-2" in a range from approximately 100 to approximately 180.

The above-described novel image forming apparatus may be configured to use toner having a spindle outer shape, and a ratio of a major axis r1 to a minor axis r2 from approximately 0.5 to approximately 1.0 and a ratio of a thickness r3 to the minor axis r2 from approximately 0.7 to approximately 1.0, and r1≧r2≧r3.

The above-described novel image forming apparatus may be configured to use the toner obtained from at least one of an elongation and a crosslinking reaction of toner composition comprising a polyester prepolymer having a function group including a nitrogen atom, a polyester, a colorant, and a releasing agent in an aqueous medium under resin fine particles.

DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
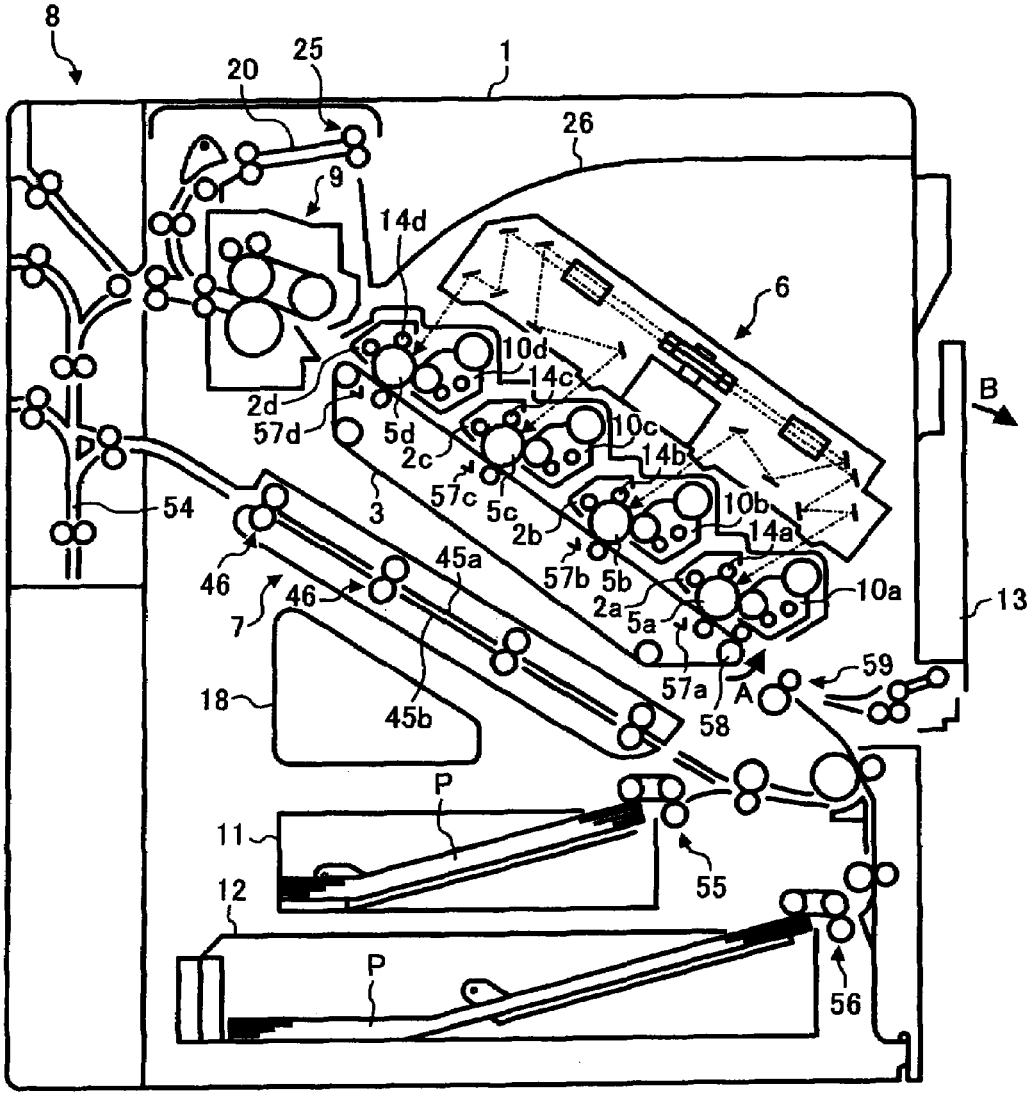
FIG. 1 is a schematic structure of a printer according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Referring to FIG. 1, a full color laser printer 1, which is hereinafter referred to as a "printer 1", is shown as one example of an electro photographic image forming apparatus according to an embodiment of the present invention. Although the printer 1 of FIG. 1 is configured to form a color image with toners of four different colors, such as magenta (m), cyan (c), yellow (y), and black (bk), the image forming apparatus can be a monochromatic printer, a copier, a facsimile machine, or other image forming apparatuses.

The printer 1 can include four photoconductive units 2*a*, 2*b*, 2*c*, and 2*d* functioning as an image forming mechanism, an image transfer belt 3 as a transfer mechanism, a writing unit 6 as a writing mechanism, a fixing unit 9 as a fixing mechanism, a toner replenishing unit (not shown) as a toner feeding mechanism, and sheet feeding cassettes 11 and 12 as a sheet feeding mechanism.

The four photoconductive units 2*a*, 2*b* 2*c*, and 2*d* include four photoconductive elements 5*a*, 5*b*, 5*c*, and 5*d*, respectively, as image bearing members, and four charging rollers 14*a*, 14*b*, 14*c*, and 14*d*, respectively. The four photoconductive units 2*a*, 2*b*, 2*c*, and 2*d* can have similar structures and functions, except that the toners are different colors to form magenta images, cyan images, yellow images, and black images, respectively.

The four photoconductive units 2*a*, 2*b*, 2*c*, and 2*d* are separately arranged at positions having different heights or elevations, in a stepped manner.

The photoconductive elements 5*a*, 5*b*, 5*c*, and 5*d* separately receive respective light laser beams emitted by the writing unit 6, such that electrostatic latent images are formed on the surfaces of the four photoconductive units 2*a*, 2*b*, 2*c*, and 2*d*.

The charging rollers 14*a*, 14*b*, 14*c*, and 14*d* serve as a charging mechanism and are held in contact with the photoconductive elements 5*a*, 5*b*, 5*c*, and 5*d* to charge respective surfaces of the photoconductive elements 5*a*, 5*b*, 5*c*, and 5*d*.

The photoconductive units 2*a*, 2*b*, 2*c*, and 2*d* further include respective brush rollers including a brush roller 15 (see FIG. 2) serving as a rotative member and respective cleaning blades including a cleaning blade 47 (see FIG. 2), both of which serve as a cleaning mechanism.

Developing units 10*a*, 10*b*, 10*c*, and 10*d* are separately disposed in a vicinity of or adjacent to the photoconductive units 2*a*, 2*b*, 2*c*, and 2*d*, respectively. The developing units 10*a*, 10*b*, 10*c*, and 10*d* store the different colored toners for the respective photoconductive units 2*a*, 2*b*, 2*c* and 2*d*.

In this embodiment, the developing units 10*a*, 10*b*, 10*c*, and 10*d* can have structures and functions similar to one another, and respectively contain a two-component type developer including a toner and a carrier mixture. More specifically, the developing units 10*a*, 10*b*, 10*c*, and 10*d* respectively use magenta toner, cyan toner, yellow toner, and black toner.

Each of the developing units 10*a*, 10*b*, 10*c*, and 10*d* includes a developing roller (not shown) facing the respective photoconductive elements 5*a*, 5*b*, 5*c*, and 5*d*, a screw conveyor (not shown) for conveying the developer while agitating the developer, and a toner content sensor (not shown).

The developing roller includes a rotatable sleeve and a stationary magnet roller disposed in the rotatable sleeve.

The transfer mechanism including the image transfer belt 3 is located or disposed below the photoconductive units 2*a*, 2*b*, 2*c*, and 2*d* (substantially at the center of the printer 1). The image transfer belt 3 is passed over or surrounds a plurality of rollers including a paper attracting roller 58. The image transfer belt 3 is held in contact with the photoconductive elements 5*a*, 5*b*, 5*c*, and 5*d* and travels in the same direction that the photoconductive elements 5*a*, 5*b*, 5*c*, and 5*d* rotate, as indicated by arrow A in FIG. 1.

Four image transfer brushes 57*a*, 57*b*, 57*c*, and 57*d* are disposed inside a loop of the image transfer belt 3 and face the respective photoconductive elements 5*a*, 5*b*, 5*c*, and 5*d*, which are accommodated in the photoconductive units 2*a*, 2*b*, 2*c*, and 2*d*.

The toner replenishing unit replenishes fresh toner to each of the developing units 10*a*, 10*b*, 10*c*, and 10*d* in accordance with an output of the toner content sensor.

The image transfer belt 3 may be implemented as a seamless belt produced by molding polyvinylidene fluoride, polyimide, polycarbonate, polyethylene terephthalate or other similar resin. If desired, carbon black or similar conductive material may be added to such resin in order to control resistance. Further, the image transfer belt 3 may be provided with a laminate structure made up of a base layer formed of the above-described resin and a surface layer formed on the base layer by, for example, spray coating or dip coating.

The writing unit 6 is provided at a position above the photoconductive units 2*a*, 2*b*, 2*c*, and 2*d*. The writing unit 6 has four laser diodes (LDs), a polygon scanner, and lenses and mirrors. The four laser diodes (LDs) serve as light sources and irradiate the respective photoconductive elements 5*a*, 5*b*, 5*c*, and 5*d* with respective imagewise laser light beams to form electrostatic latent images thereon. The polygon scanner including a polygon mirror having six surfaces and a polygon motor. Lenses such as f-theta lenses, elongate WTLs, and other lenses, and mirrors are provided in an optical path of the respective laser light beams. The laser light beams emitted from the laser diodes are deflected by the polygon scanner to irradiate the photoconductive elements 5*a*, 5*b*, 5*c*, and 5*d*.

The sheet feeding mechanism also includes a duplex print unit 7, a reverse unit 8, a manual sheet feeding tray 13, a reverse discharging path 20, a sheet discharging roller pair 25 and a discharging tray 26.

The duplex print unit 7 is provided at a position below the image transfer belt 3.

The duplex print unit 7 includes a pair of guide plates 45*a* and 45*b*, and plural pairs of sheet feeding rollers 46. When a duplex image forming operation is performed, the duplex print unit 7 receives the recording paper P on one side of which an image is formed and which is fed to the duplex print unit 7 after the recording paper P is switched back at a reverse transporting passage 54 of the reverse unit 8. The duplex print unit 7 then transports the recording paper P to the sheet feeding mechanism.

The reverse unit 8 is provided on a left side of the printer 1 of FIG. 1, which discharges a recording paper P on which an image is formed after reversing the recording paper P or feeds the recording paper P to the duplex print unit 7. The reverse unit 8 includes plural pairs of feeding rollers and plural pairs of feeding guides of the reverse transporting passage 54. As described above, the reverse unit 8 feeds the recording paper P on which an image is formed to the duplex print unit 7 after reversing the recording paper P or discharges the recording paper P without reversing the recording paper P.

The recording paper P is fed from one of the sheet feeding cassettes 11 and 12 with the respective sheet separation and feed units 55 and 56. The recording paper P is fed to the photoconductive units 2*a*, 2*b*, 2*c*, and 2*d* in synchronization with a pair of registration rollers 59 so that the color toner images formed on the photoconductive elements 5*a*, 5*b*, 5*c*, and 5*d* are transferred onto a proper position of the recording paper P.

The fixing unit 9 serving as the fixing mechanism is positioned between the image transfer belt 3 and the reverse unit 8 for fixing an image formed on the recording paper P. The reverse discharge path 20 branches off a downstream side of the fixing unit 9 in the direction in which the recording paper P is conveyed, so that the recording paper P conveyed into the reverse discharge path 20 is driven out to the discharging tray 26 by the sheet discharging roller pair 25.

The sheet feeding mechanism is arranged in a lower portion of the printer 1, and includes the sheet feeding cassettes 11 and 12, sheet separation and feed units 55 and 56 assigned to the sheet feeding cassettes 11 and 12, respectively, and the pair of registration rollers 59. The sheet feeding cassettes 11 and 12 are loaded with a stack of sheets of particular size including the recording paper P. When an image forming operation is performed, the recording paper P is fed from one of the sheet feeding cassettes 11 and 12 and is conveyed toward the pair of registration rollers 59.

In addition, the manual sheet feeding tray 13 is mounted on the right side of the printer 1 of FIG. 1. The manual sheet feeding tray 13 is openable in a direction indicated by arrow B. After opening the manual sheet feeding tray 13, an operator of the printer 1 may feed sheets by hand.

A full-color image forming operation of the printer 1 is now described.

When the printer 1 receives full color image data, each of the photoconductive elements 5*a*, 5*b*, 5*c*, and 5*d* rotates in a clockwise direction in FIG. 1 and is uniformly charged with the corresponding charging rollers 14*a*, 14*b*, 14*c*, and 14*d*. The writing unit 6 irradiates the photoconductive elements 5*a*, 5*b*, 5*c*, and 5*d* of the photoconductive units 2*a*, 2*b*, 2*c*, and 2*d* with the laser light beams corresponding to the respective color image data, resulting in formation of electrostatic latent images, which correspond to the respective color image data, on respective surfaces of the photoconductive elements 5*a*, 5*b*, 5*c*, and 5*d*. The electrostatic latent images formed on the respective photoconductive elements 5*a*, 5*b*, 5*c*, and 5*d* are developed with the respective developers including respective color toners at the respective developing units 10*a*, 10*b*, 10*c*, and 10*d*, resulting in formation of magenta, cyan, yellow and black toner images on the respective photoconductive elements 5*a*, 5*b*, 5*c*, and 5*d*.

The recording paper P is fed from one of the sheet feeding cassettes 11 and 12 with the respective sheet separation and feed units 55 and 56 or from the manual feeding tray 13. The recording paper P is fed to the photoconductive units 2*a*, 2*b*, 2*c*, and 2*d* in synchronization with the pair of registration rollers 59 so that the color toner images formed on the photoconductive elements 5*a*, 5*b*, 5*c*, and 5*d* are transferred onto a proper position of the recording paper P. The recording paper P is positively charged with the paper attracting roller 58, and thereby the recording paper P is electrostatically attracted by the surface of the image transfer belt 3. The recording paper P is fed while the recording paper P is attracted by the transfer belt 3, and the magenta, cyan, yellow and black toner images are sequentially transferred onto the recording paper P, resulting in formation of a full color image in which the magenta, cyan, yellow and black toner images are overlaid.

The full color toner image on the recording paper P is fixed by the fixing unit 9 through the application of heat and pressure. The recording paper P having the fixed full color image is fed through a predetermined passage depending on image forming instructions. Specifically, the recording paper P is discharged to the sheet discharging tray 26 with an image side facing downward, or is discharged from the fixing unit 9 after passing through the reverse unit 8. Alternatively, when a duplex image forming operation is specified, the recording paper P is fed to the reverse transporting passage 54 and is switched back to be fed to the duplex print unit 7. Then another image is formed on the other side of the recording paper P by the photoconductive units 2*a*, 2*b*, 2*c*, and 2*d*, and a duplex print copy having color images on both sides of the recording paper P is discharged. When a request producing two or more copies is specified, the image forming operation described above is repeated.

After the respective toner images are transferred, the brush rollers and the cleaning blades clean the corresponding surfaces of the photoconductive elements 5*a*, 5*b*, 5*c*, and 5*d* so as to prepare for the next image forming operation.

Next, the image forming operation for producing black and white copies is described.

When the printer 1 receives a command to produce black and white copies according to black and white image data, a driven roller (not shown) facing the paper attracting roller 58 and supporting the image transfer belt 3 is moved downward, thereby separating the image transfer belt 3 from the photoconductive units 2*a*, 2*b*, and 2*c*. The photoconductive element 5*d* of the photoconductive unit 2*d* rotates in the clockwise direction in FIG. 1 to be uniformly charged with the corresponding charging roller 14*d*. Then an imagewise laser light beam corresponding to the black and white image data irradiates the photoconductive element 5*d*, resulting in formation of an electrostatic latent image on the photoconductive element 5*d*. The electrostatic latent image formed on a surface of the photoconductive element 5*d* is developed with the black developing device 10*d*, resulting in formation of a black toner image on the photoconductive element 5*d*. In this case, the photoconductive units 2*a*, 2*b*, and 2*c*, and the developing units 10*a*, 10*b*, and 10*c* are not activated. Therefore, undesired abrasion of the photoconductive elements 5*a*, 5*b*, and 5*c* and undesired consumption of the toners other than the black toner can be prevented.

The recording paper P is fed from one of the paper feeding cassettes 11 and 12 with the respective one of the sheet separation and feed units 55 and 56 or from the manual feeding tray 13. The recording paper P is fed toward the image transfer belt 3 in synchronization with the pair of registration rollers 59 such that the black toner image formed on the photoconductive element 5*d* is transferred to a proper position of the recording paper P. The recording paper P is positively charged with the paper attracting roller 58 so that the recording paper P is electrostatically attracted by the surface of the image transfer belt 3. Since the recording paper P is fed while the recording paper P is attracted by the image transfer belt 3, the recording paper P can be fed to the photoconductive element 5*d* even when the photoconductive elements 5*a*, 5*b*, and 5*c* are separated from the image transfer belt 3, resulting in formation of the black color image on the recording paper P. To stably feed the recording paper P under electrostatic adhesion, at least the outermost layer of the image transfer belt 3 is made of a material having a high resistance.

After the black toner image is fixed by the fixing unit 9, the recording paper P having the black toner image on the surface is discharged. When a request producing two or more copies is specified, the image forming operation described above is repeated.

Figure 2:
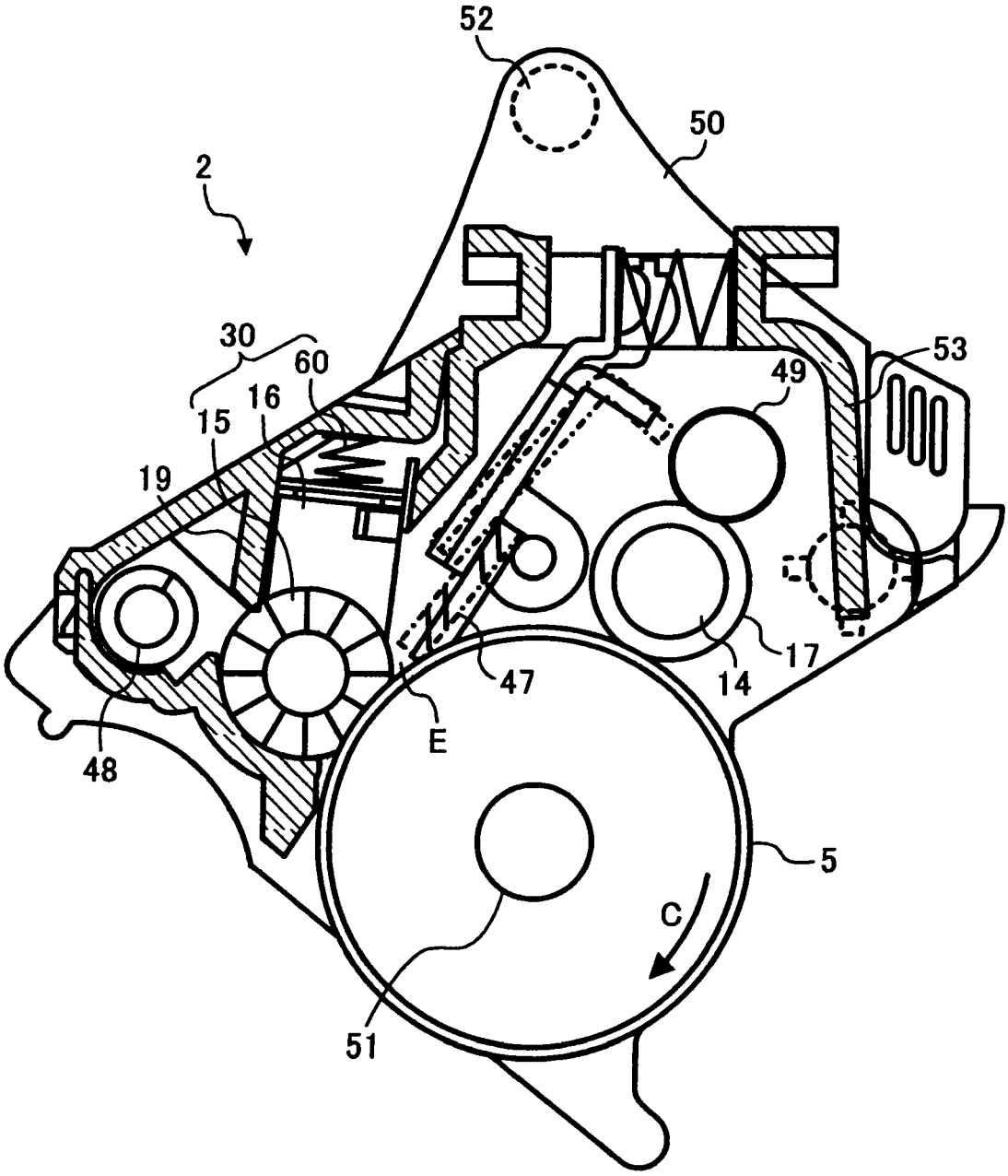
FIG. 2 is an enlarged view showing an image forming unit of the printer shown in FIG. 1.

Referring to FIG. 2, a structure of one of the photoconductive units 2*a*, 2*b*, 2*c*, and 2*d* is described.

Each of the photoconductive units 2*a*, 2*b*, 2*c*, and 2*d* has the same respective components. Since the photoconductive units 2*a*, 2*b*, 2*c*, and 2*d* have similar structures and functions to each other, except that the toners contained therein are of different colors, the discussion below with respect to FIG. 2 use reference numerals for specifying components of the full-color printer 1 without suffixes such as "a", "b", "c", and "d". In other words, the photoconductive unit 2 of FIG. 3, for example, can be any one of the photoconductive units 2*a*, 2*b*, 2*c*, and 2*d*.

As shown in FIG. 2, the photoconductive unit 2 includes the photoconductive element 5, the charging roller 14, the brush roller 15, a flicker 19, the cleaning blade 47, a toner transporting auger 48, and a charge cleaning roller 49.

The brush roller 15 moves toner scraped off the photoconductive element 5 by the cleaning blade 47 toward the toner transporting auger 48.

The flicker 19 flicks and removes toner particles adhered to the brush roller 15 and the toner transporting auger 48 conveys the toner particles removed from the brush roller 15 to a used toner container 18. In the illustrative embodiment, the photoconductive element 5 has a diameter of 30 mm, for example, and is caused to rotate at a speed of 162 mm/sec in a direction indicated by an arrow C in FIG. 2. The brush roller 15 rotates in a clockwise direction in FIG. 2, in synchronization with the rotation of the photoconductive element 5.

The charge cleaning roller 49 cleans a surface of the charging roller 14.

The photoconductive unit 2 includes a main reference positioning member 51, a front subreference positioning member 52 and a rear subreference positioning member 53. The subreference positioning members 52 and 53 are formed integrally with a single bracket 50. With this configuration, the photoconductive unit 2 can be accurately positioned relative to the printer 1 when the photoconductive unit 2 is mounted to the printer 1.

The photoconductive element 5 and the charging roller 14 are mounted on the photoconductive unit 2, and therefore are positioned relative to each other within the photoconductive unit 2. When the entire photoconductive unit 2 is replaced, the photoconductive element 5 and the charging roller 14 may be removed together from the printer 1. This allows a user of the printer 1 to easily replace the photoconductive unit 2 without performing a gap adjustment. While the photoconductive element 5, the charging roller 14 and the cleaning blade 47 are shown as being formed as one unit, the cleaning blade 47 may be mounted to another unit. Further, the developing unit 10 may be formed into one unit together with the photoconductive element 5, the charging roller 14, and other image forming components in the photoconductive unit 2.

As described above, the charging roller 14 and the photoconductive element 5 may integrally be formed into a single process cartridge removably mounted to the printer 1. According to the above-described structure, the charging roller 14 and the photoconductive element 5, whose useful lives are being extended, do not require frequent replacement and can be easily replaced together.

The charging roller 14 abuts against the surface of the photoconductive element 5 via a gap supporting member 17, forming a gap between the charging roller 14 and the photoconductive element 5.

The charging roller 14 may have a metallic core formed of stainless steel or other similar metal. The diameter of the metallic core is preferably made between approximately 6 mm and approximately 10 mm. If the diameter of the metallic core is excessively smaller than 6 mm, deformation of the core is not negligible when machined or pressed against the photoconductive element 5, making it difficult to accurately provide a desired gap. Conversely, if the diameter of the metallic core is excessively greater than 10 mm, the charging roller 14 becomes bulky or heavier.

Further, the charging roller 14 is preferably formed of a material having a volumetric resistance between approximately $10^4$ Ωcm and approximately $10^9$ Ωcm. If the volumetric resistance of the charging roller 14 is excessively lower than $10^4$ Ωcm, a leakage of a charge bias may tend to occur when pin holes, for example, or other similar defects exist in the photoconductive element 5. If the volumetric resistance of the charging roller 14 is excessively higher than $10^9$ Ωcm, the charge bias may not substantially be discharged and a charge potential may not be established. The charging roller 14 is connected to a power source (not shown) so that a predetermined amount of voltage can be applied to the charging roller 14. It is preferable that the direct-current voltage superimposed with the alternating-current voltage is applied to the charging roller 14, which can further uniformly charge the surface of the photoconductive element 5.

As previously described, the charge cleaning roller 49 is disposed above the charging roller 14 to clean the surface of the charging roller 14. The charge cleaning roller 49 includes a metallic core having a diameter of approximately 5 mm, and a roller formed of, for example, an insulative sponge material called a melamine foam. The roller including the insulative material is adhered to the metallic core. The charge cleaning roller 49 can rotatably abut against the charging roller 14 because of the weight of the charge cleaning roller 49. The charge cleaning roller 49 is rotated with the rotation of the charging roller 14 in the same direction as the charging roller 14 so that the surface of the charging roller 14 can be cleaned.

The brush roller 15 and the cleaning blade 47 are disposed in contact with the photoconductive element 5, respectively. As previously described, the flicker 19 flicks and removes toner particles adhered to the brush roller 15 and the toner transporting auger 48 conveys the toner particles removed from the brush roller 15 to the used toner container 18. The brush roller 15 includes a fibrous brush of a thickness of approximately 5 deniers to approximately 15 deniers in a circumference of its rotative supporting axis with a density of approximately 20,000 fibers to approximately 100,000 fibers per square inch.

The photoconductive unit 2 further includes a molded lubricant 16 and a pressure spring 60. The brush roller 15, the molded lubricant 16, and the pressure spring 60 serve as a lubricant supplying device 30.

The molded lubricant 16 applies lubricant onto the surface of the photoconductive element 5 so as to reduce the coefficient of friction of the surface of the photoconductive element 5.

The pressure spring 60 serves as a pressure member to press contact the molded lubricant 16 with the brush roller 15. The brush roller 15 rotates to scrape the molded lubricant 16 into lubricant shavings in a powder shape and adhere the powder of the molded lubricant 16 to the fibrous brush of the brush roller 15. When the lubricant shavings of the molded lubricant 16 are conveyed to a contact area between the brush roller 15 and the photoconductive element 5, the lubricant shavings are applied to the surface of the photoconductive element 5.

Specific examples of the molded lubricant 16 are metal salts of fatty acids such as lead oleate, zinc oleate, copper oleate, zinc stearate, cobalt stearate, iron stearate, copper stearate, zinc palmitate, copper palmitate, and zinc linoleate; fluorine resin particles such as polytetrafluoroethylene, polychlorotrifluoroethylene, polyvinylidenefluoride, polytrifluorochloroethylene, polydichloro difluoroethylene, tetrafluoroethylene ethylene copolymers, and tetrafluoroethylene-hexafluoropropylene copolymers. The metal salts of fatty acids are preferable to substantially reduce the friction coefficient of the photoconductive element 5. Among these materials, zinc stearate is most preferable.

Thus, the brush roller 15 performs two different functions while rotating. That is, the brush roller 15 collects toner remaining on the surface of the photoconductive element 5 and applies the molded lubricant 16 onto the surface of the photoconductive element. Application of the molded lubricant 16 onto the surface of the photoconductive element 5 can reduce the coefficient of friction on the surface of the photoconductive element 5, and the cleaning blade 47 can remove toner remaining on the surface of the photoconductive element 5. Therefore, the photoconductive element 5 may not receive any damage on its surface and can effectively be cleaned. Further, toner that is removed by the cleaning blade 47 from the surface of the photoconductive element 5 is conveyed to a portion indicated as "E" in FIG. 2. The toner accumulated in the portion E is collected by the brush roller 15 in rotation, is flicked by the flicker 19, and is conveyed by the toner transporting auger 48. By rotating the toner transporting auger 48, the collected toner is conveyed to the toner container 18 shown in FIG. 1.

The molded lubricant 16 according to the exemplary embodiment has a Martens hardness of approximately 40 $N/mm^2$ to approximately 70 $N/mm^2$. The Martens hardness of the molded lubricant was measured at a test force of 50 mN and a load-applying period of 30 seconds. The load was started from 0 mN and was increased for 30 seconds to obtain the above-described test force. The measurement was performed under the temperature of 23 degree Celsius and a humidity of 50%. The pressure force of the molded lubricant 16 is from approximately 2 N/m to approximately 12 N/m. When the molded lubricant 16 has the Martens hardness of 70 $N/mm^2$ or greater, a load applied to the molded lubricant 16 for scraping becomes greater. This can break the molded lubricant 16 and/or make the fibers of the fibrous brush tilt. A spring constant of the pressure spring 60 for applying the pressure force becomes greater, which can cause a difference between the initial value and the aged value. This can increase the amount of lubricant consumed, and result in a shortage of lubricant due to aging.

When a weight is used as a pressuring means to abut the molded lubricant 16 against the brush roller 15, the space for disposing the weight and the brush roller 15 becomes greater.

When the molded lubricant 16 having the Martens hardness smaller than 40 $N/mm^2$ is used, it is likely to break or chip the molded lubricant during machine operation, manufacturing process, secondary fabrication, and/or transportation. Further, since the molded lubricant 16 with the Martens hardness smaller than 40 $N/mm^2$ is too soft, the amount of lubricant consumed is likely to increase resulting in the charging roller 14 becoming contaminated and reducing life of the charging roller 14 and the charge cleaning roller 49. Accordingly, it is preferable to use the molded lubricant 16 having the Martens hardness between approximately 40 $N/mm^2$ and approximately 70 $N/mm^2$.

The brush roller 15 includes a brush material made of polyester fibers. The polyester fibers infrequently tilt, can stably scrape the molded lubricant 16 even after a long period of time, and can stably apply the molded lubricant 16 onto the photoconductive element 5. The brush roller 15 also includes an insulative material. This can reduce the costs and increase the brush roller's cleaning ability.

The brush roller 15 can rotate in the same direction as the photoconductive element 5 at a point contacting the photoconductive element 5. By rotating the brush roller 15 in the same direction as the photoconductive element 5, the lubricant adhered to the brush roller 15 can be applied to the photoconductive element 5 without impacting the photoconductive element 5. It is preferable that a ratio of the circumferential velocity of the brush roller 15 and the photoconductive element 5 falls in a range from approximately 0.8 to approximately 1.2.

When the ratio of circumferential velocity of the brush roller 15 relative to the photoconductive element 5 is smaller than 0.8, an amount of lubricant to be applied may be reduced, which can result in a poor cleaning ability and increased filming.

When the ratio of circumferential velocity of the brush roller 15 and the photoconductive element 5 is greater than 1.2, a large impact may be exerted on the photoconductive element 5, which may damage the photoconductive element 5. This may reduce the duration of the life of the photoconductive element 5.

When the brush roller 15 applies a predetermined amount of lubricant to the photoconductive element 15 with a smaller impact, it is more preferable that the ratio of circumferential velocity of the brush roller 15 relative to the photoconductive element 5 falls in a range from approximately 1.0 to approximately 1.1.

As previously described, the printer 1 according to the exemplary embodiment uses the charging roller 14 employing a direct-current voltage superimposed with an alternating-current voltage. When such printer is used, lubricant is preferably applied on the photoconductive element 5 to decrease the coefficient of friction of the photoconductive element 5. By setting the ratio of circumferential velocity of the brush roller 15 and the photoconductive element 5 in a range from approximately 0.8 to approximately 1.2, an optimal amount of lubricant can be applied so as to reduce a friction resistance of the photoconductive element 5, which can provide good cleaning ability and reduce the chance of filming.

Figure 3:
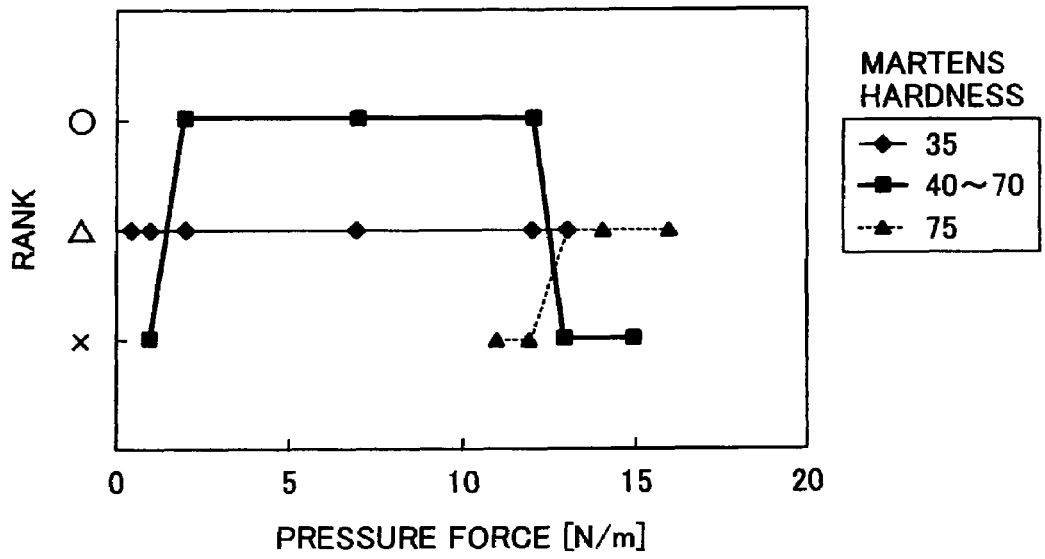
FIG. 3 is a graphical representation of a relationship of an image rank and a pressure force.

Referring to FIG. 3, a graph showing a relationship of an image rank and a pressure force that is obtained from a test run of the printer 1 is described. The vertical axis reflects the ranks of images tested, and the horizontal axis shows a pressure force applied to the molded lubricant 16.

When the Martens hardness of the molded lubricant 16 was smaller than 40 N/mm$^2$, the molded lubricant 16 was broken or chipped, and the pressure force applied to the molded lubricant 16 caused defect images.

When the Martens hardness of the molded lubricant 16 was greater than 70 N/mm$^2$, the filming occurred and the fibers of the fibrous brush of the brush roller 15 tilted, and the pressure force applied to the molded lubricant 16 caused defect images.

When the Martens hardness of the molded lubricant 16 was set between approximately 40 N/mm$^2$ and approximately 70 N/mm$^2$, no filming occurred under the pressure force from 2 N/m to 12 N/m even after a test run with 600,000 sheets was processed. When the Martens hardness of the molded lubricant 16 was set to a value other than the value set between approximately 40 N/mm$^2$ and approximately 70 N/mm$^2$, the filming, breaking or chipping of the molded lubricant 16, and/or tilting of the fibrous brush of the brush roller 15 occurred, resulting in an image defect. In light of the respective life spans of the molded lubricant 16 and the charge cleaning roller 49 for the charging roller 17, it is more preferable that the pressure force is in a range from approximately 2 N/m to approximately 8 N/m.

Now, a contact portion of the molded lubricant 16 and the brush roller 15 is described.

To increase the cleaning ability, inorganic fine particles are added externally to toner. The inorganic fine particles, however, can adhere to the surface of the photoconductive element and can result in filming, which can result in an image defect.

One preferred inorganic fine particle is silica having an average diameter (especially of a primary particle) in a range from approximately 80 nm to approximately 300 nm. Silica is used because silica in a range of approximately 80 nm to approximately 300 nm can improve the cleaning ability of residual toner by a so called dam effect. However, the added silica may cause filming over the photoconductive element 5.

An effective countermeasure is to apply the lubricant made of zinc stearate onto the surface of the photoconductive element to prevent the filming. However, when a new photoconductive element unit is used, the molded lubricant 16 is also new and the surface of the molded lubricant 16 is covered with a skin layer. In this condition, the brush roller 15 cannot easily scrape the molded lubricant 16, and the amount of the molded lubricant 16 to be supplied becomes low, which can cause the filming.

In the present invention, the contact portion of the molded lubricant 16 and the brush roller 15 includes a corner portion of the molded lubricant 16. When compared to a configuration where the brush roller 15 contacts a flat portion of the molded lubricant 16, the brush roller 15 contacting the corner portion of the molded lubricant 16 can easily scrape the skin layer of the surface of the molded lubricant 16, and a predetermined amount of the molded lubricant 16 of zinc stearate can be provided at the time of the first use, thereby avoiding the filming.

Table 1 shows test results of a comparison of the amount of lubricant used when the brush roller 15 contacts the flat portion of the molded lubricant 16 and the amount used when the brush roller 15 contacts the corner portion of the molded lubricant 16, and a rank of the filming.

TABLE 1

| | ZnSt consumed (g/100 sheets) | ZnSt consumed (life) (g/60k sheets) | Filming rank |
|---|---|---|---|
| Flat portion | 0.01-0.02 | 8.392 | Not acceptable |
| Corner portion | 0.04-0.07 | 8.380 | Acceptable |

Further, in the present invention, a surface of the molded lubricant 16 at the contact portion with respect to the brush roller 15 is cut off before the molded lubricant 16 is mounted on the lubricant supplying device 30. By removing the skin layer of the new molded lubricant 16 at the contact portion with respect to the brush roller 15, the brush roller 15 can easily scrape the molded lubricant 16 so as to apply a predetermined amount of the zinc stearate of the molded lubricant, thereby preventing the filming.

Figure 4:
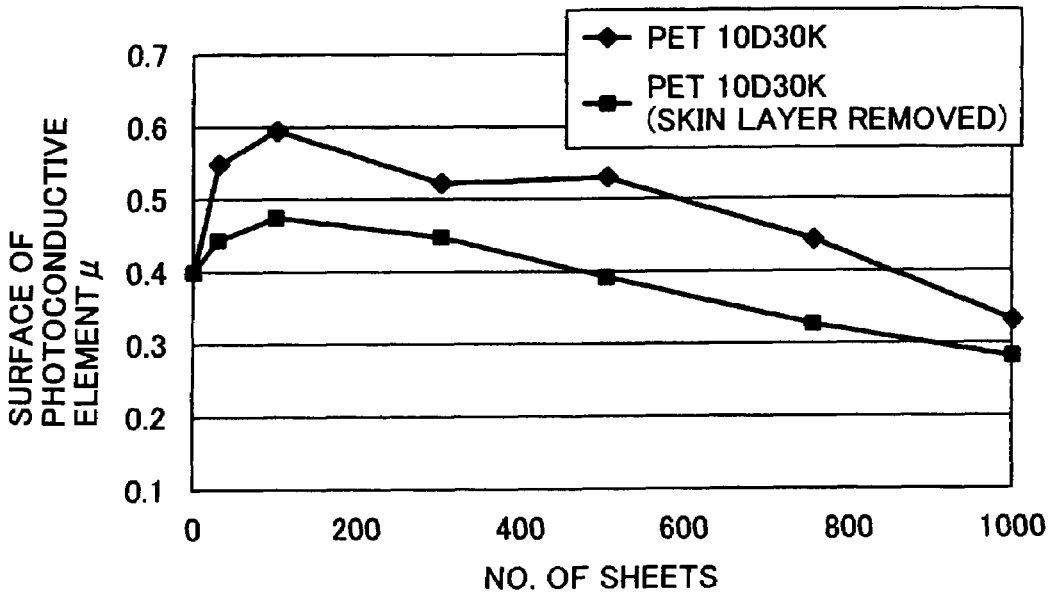
FIG. 4 is a graphical representation of changes of a coefficient of friction of the photoconductive element.

Referring to FIG. 4, a graph showing changes of a coefficient of friction of the photoconductive element 5 for a new photoconductive unit including the new molded lubricant 16 is described.

The test was conducted with a molded lubricant with its skin layer and without its skin layer in order to see how a coefficient of friction μ of the photoconductive element 5 changes during an image forming operation.

In FIG. 4, when a recording medium is conveyed to the photoconductive unit, the coefficient of friction μ on a surface of the photoconductive element 5 increases because of the alternating-current charging, external additives of toner, powder of toner, and so on. When the molded lubricant 16 is applied to the surface of the photoconductive element 5, the amount of zinc stearate to apply increases, which reduces the coefficient of friction μ. If the rising amount of the coefficient of friction μ is large, the filming can occur. As shown in FIG. 4, when the skin layer of the molded lubricant 16 is removed, the coefficient of friction μ can be reduced. More specifically, the coefficient of friction μ with a fewer number of sheets can be regulated to 0.3 or less, which can prevent an occurrence of filming.

The photoconductive element 5 includes a conductive core, an under layer formed on the conductive core, and a charge generating layer and a charge transport layer sequentially formed on the under layer. The charge generating layer and the charge transport layer are formed of a charge generating substance and a charge transport substance, respectively.

The conductive core may be implemented as, for example, a pipe or cylinder formed of aluminum, stainless steel or similar metal or an endless belt formed of nickel so long as the conductive core has volumetric resistance of $10^4$ Ωcm or less.

While the undercoat layer includes resins, the resins should preferably have high solution resistance against general organic solvents when consideration is given to the fact that a photoconductive layer is formed on the undercoat layer by use of a solvent. Resins of this kind include water soluble resin such as polyvinyl alcohol resin, alcohol soluble resin such as copolymerized nylon, and curing type resin forming a three-dimensional network, such as polyurethane resin, alkyd-melamine resin or epoxy resin. Fine powder of metal oxides, such as titanium oxide, silica and alumina may be added to the undercoat layer for obviating moir and reducing residual potential. The undercoat layer may be formed by use of a desired solvent and a desired coating method. A thickness of the undercoat layer may preferably be approximately 0 μm to approximately 5 μm.

The charge generating layer includes a charge generating material. Typical materials of the charge generating material are monoazo pigment, disazo pigment, trisazo pigment, and phthalocyanine-based pigment. The charge generating layer may be formed by dispersing the charge generating material together with the binder resin such as polycarbonate into a solvent, such as tetrahydrofuran or cyclohexanone to thereby prepare a dispersion solution, and coating the solution by dipping or spraying. A thickness of the charge generating layer is usually approximately 0.01 μm to approximately 5 μm.

The charge transport layer may be formed by dissolving or dispersing the charge transport material and binder resin into a desired solvent, e.g., tetrahydrofuran, toluene or dicycloethane, and coating and then drying the resulting mixture. Among the charge transport materials, the charge transport materials of low molecular weight include an electron transport material and a hole transport material. The electron transport material may be implemented by an electron receiving material, e.g., chloranil, bromanil, tetracyanoethylene, tetracyanoquinodimethane, 2,4,7-trinitro-9-fluorenone, 2,4,5,7-tetranitro-9-fluorenone, or 1,3,7-trinitrodibenzothiophene-5,5-dioxide. The hole transport material may be implemented by an electron donative material, e.g., oxazole derivatives, oxadiazole derivatives, imidazole derivatives, triphenylamine derivatives, phenyl hydrazones, α-phenylstilbene derivatives, thiazole derivatives, triazole derivatives, phenazine derivatives, acridine derivatives or thiophene derivatives.

The binder resin used for the charge transport layer together with the charge transport material may be any one of a thermoplastic or thermosetting resin, e.g., polystyrene resin, styrene-acrylonitrile copolymer, styrene-butadiene copolymer, polyester resin, polyallylate resin, polycarbonate resin, acryl resin or epoxy resin, melamine resin and phenol resin. A thickness of the charge transport layer may advantageously be selected within a range of approximately 5 μm to approximately 30 μm in accordance with desired characteristics of the photoconductor.

A protective layer may be formed on the surface of the photoconductive element 5 as a surface layer for protecting the photoconductive layer and enhancing the durability of the photoconductive layer. The protective layer including a binder resin with a filler may protect the photoconductive layer and mechanically improve the durability. An amount of the filler added to the protective layer is preferably from approximately 10 to approximately 70 parts by weight per 100 parts by weight of the binder resin, and more preferably from approximately 20 to approximately 50 parts by weight per 100 parts by weight of the binder resin. If the amount of the filler is less than 10 parts by weight, abrasion of the protective layer can increase and the durability of the protective layer can decrease. If the amount is greater than 70 parts by weight, sensitivity of the photoconductive element 5 can significantly decrease and the residual potential of the photoconductive element 5 can increase. Specific examples of filler added to the protective layer include fine powders of metal oxides such as titanium oxides, silica, and alumina.

It is preferable that an average particle diameter of the filler added to the protective layer is from approximately 0.1 μm to approximately 0.8 μm. If the average particle diameter of the filler is too large, exposure light can be scattered by the protective layer. The scattered exposure light lowers the resolving power, resulting in deterioration of an image quality. If the average particle diameter of the filler is too small, an abrasion resistance can decrease. The protective layer is formed by dispersing a filler and a binder resin in an appropriate solvent, and applying the dispersion liquid obtained as described above onto the photoconductive layer using a spray coating method. As binder resins and solvents for use in the protective layer, materials similar to those used in the charge transport layer may be used. Specific examples of the resins for use as the binder resin of the protective layer include a thermoplastic or thermosetting resin, e.g., polystyrene resin, styrene-acrylonitrile copolymer, styrene-butadiene copolymer, polyester resin, polyallylate resin, polycarbonate resin, acryl resin, epoxy resin, melamine resin and phenol resin. Specific examples of desired solvents are tetrahydrofuran, toluene and dicycloethane.

A thickness of the protective layer is preferably from approximately 3 μm to approximately 10 μm to improve the durability of the protective layer and maintain electrostatic characteristics of the photoconductive layer. A charge transport material and an antioxidant may be added to the protective layer.

The protective layer of an organic photoconductive element is not limited to the protective layer formed by a dispersant including the filler. A protective layer of a cross-linking resin formed by incorporating a specific cross-linking compound into an organic silicon compound may also improve a mechanical strength of the photoconductive element 5.

In the printer 2 of this embodiment, the photoconductive element 5, the charging mechanism including the charging member 14, the cleaning mechanism including the brush roller 15 and the cleaning blade 47, and the lubricant supplying mechanism including the lubricant 16 may be integrally assembled in a process cartridge. Alternatively, the developing unit 10 may be additionally integrally assembled in the process cartridge. The process cartridge may be detachably attached to the printer 1 for easy maintenance. The process cartridge may be replaced with a new one at the end of its useful life.

With the process cartridge, small toner particles having a substantially spherical shape may be effectively removed from the photoconductive element 5 in the image forming process, thereby preventing deterioration in image quality.

Further, the process cartridge is useful for easy maintenance. In a case in which the printer 1 has a problem due to at least one of the photoconductive element 5, the charging mechanism, the cleaning mechanism, the lubricant supplying mechanism and/or the developing unit 10, a replacement of the process cartridge can easily restore the printer 1 to its original state, thereby reducing a period of time for servicing.

Further, ease of removal of toner particles on the photoconductive element 5 may contribute highly to a long life time of the process cartridge.

As previously described, when the coefficient of friction μ can be regulated to 0.3 or less. When the coefficient of friction μ is greater than 0.3, it is not likely to prevent an occurrence of filming.

The coefficient of static friction of the photosensitive drum 1 can be measured by Euler's method as described below.

Figure 5:
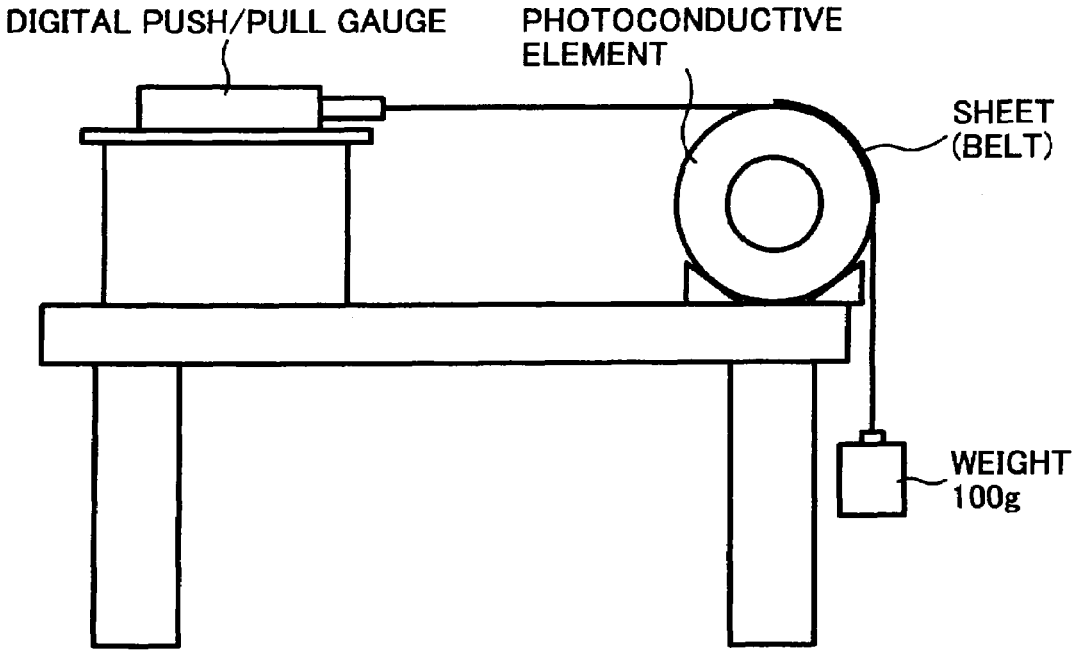
FIG. 5 is a side elevation view showing a measurement of a coefficient of friction of the photoconductive element of the printer.

FIG. 5 is a side elevation view showing a measurement of the coefficient of static friction of the photoconductive element. In this case, a good quality paper of medium thickness is stretched longitudinally as a belt over one fourth of a circumference of the photoconductive element 1 in the direction of pulling. Both ends in a pulling direction of the good quality paper are provided with strings as a member supporting the paper. A weight of 0.98 N (100 gram) is suspended from one side of the belt. A force gauge installed on the other end is pulled. Further, a load, when the belt is moved, is measured and used in the following relation: $\mu s=2/\pi\times 1\ n\ (F/0.98)$, where "μs" is a coefficient of static friction, and where "F" is the measured value. The friction coefficient of the photoconductive element 1 of the printer 1 is set to a value when the rotation becomes stable due to the image forming. Since the friction coefficient of the photoconductive element 1 is affected by other units disposed in the printer 1, the value depends on a friction coefficient obtained immediately after the image forming is completed. However, the value of the friction coefficient may substantially become stable after 1,000 A4-size recording sheets are printed. Therefore, a friction coefficient described here is determined to be a friction coefficient obtained in a stable condition.

Preferably, the toner particle has an average circularity of from approximately 0.93 to approximately 1.00.

The circularity is defined by the following equation 1:

Circularity *SR* of a particle=(circumference of circle identical in area with the projected grain image of the particle/circumference of the projected grain image) Equation 1.

As the shape of a toner particle is close to a truly spherical shape, the value of circularity becomes close to 1.00. The toner particle preferably has an average circularity from 0.93 to 1.00. It is because the resultant toner particles have a smooth surface and have a small contact area formed between toner particles or a toner particle and the photoconductive element 5 that the toner particles have good transferability.

In a blade type cleaning mechanism, the toner particles having a substantially spherical shape can easily fall in a gap between the photoconductive element 5 and the cleaning blade 47. The printer 1 according to the exemplary embodiment causes the brush roller 15 to effectively apply the lubricant to the surface of the photoconductive element 5 so that the coefficient of friction of the surface of the photoconductive element 5 can be reduced. Consequently, the cleaning blade 47 scrapes the toner remaining on the surface of the photoconductive element 5, and a good cleaning ability is obtained.

Further, the toner used in the image forming apparatus has a volume average particle size in a range from approximately 3 μm to approximately 8 μm. The particles of the toner are small in size and are in a range from approximately 1.00 to approximately 1.40 of ratio (Dv/Dn) of the volume average particle size (Dv) and the number average particle size (Dn) and the particle size distribution is narrow. By narrowing the particle size distribution, the charging distribution of the toner becomes uniform and it is possible to achieve a high quality image with less excessive concentration of toner at a particular point on the paper and to have a higher transferring rate. It has been difficult to clean such toner having a small particle size with the blade type cleaning mechanism and overcoming the adhesive power of the toner on the photoconductive element 5. When the toner has such a small particle size, the amount of fine particles of additives, etc. of the toner may be relatively high. These fine particles may be separated from the toner particles, easily causing toner filming on the surface of the photoconductive element 5. However, the printer 1, according to the exemplary embodiment, can reduce the coefficient of friction of the surface of the photoconductive element 5, thereby the cleaning ability of the cleaning blade 47 can be improved.

It is preferable that a shape factor "SF-1" of the toner used in the printer 1 is in a range from approximately 100 to approximately 180, and the shape factor "SF-2" of the toner is in a range from approximately 100 to approximately 180.

Figure 6A:
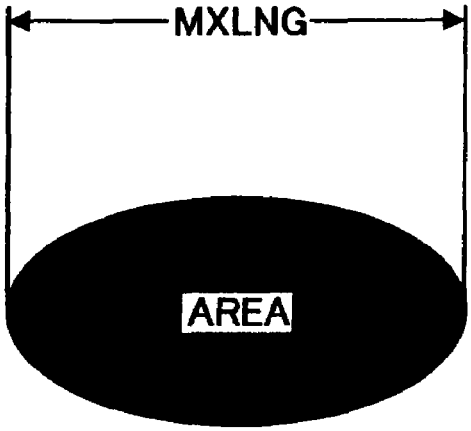
FIGS. 6A and 6B are schematic views showing exemplary toner shapes having "SF-1" and "SF-2" shapes, respectively.

Referring to FIG. 6A, the shape factor "SF1" is a parameter representing the roundness of a particle. The shape factor "SF-1" of a particle is calculated by the following Equation 2:

$$SF1=\{(MXLNG)^2/\mathrm{AREA}\}\times(100\pi/4) \qquad \text{Equation 2,}$$

where "MXLNG" represents the maximum major axis of an elliptical-shaped figure obtained by projecting a toner particle on a two dimensional plane, and "AREA" represents the projected area of elliptical-shaped figure.

When the value of the shape factor "SF-1" is 100, the particle has a perfect spherical shape. As the value of the "SF-1" increases, the shape of the particle becomes more elliptical.

Figure 6B:
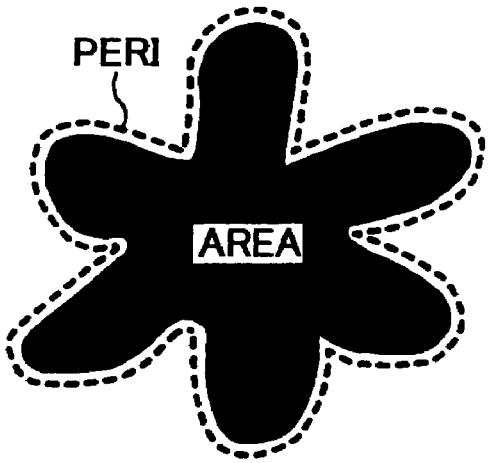

Referring to FIG. 6B, the shape factor "SF-2" is a value representing irregularity (i.e., a ratio of convex and concave portions) of the shape of the toner. The shape factor "SF-2" a particle is calculated by the following Equation 3:

$$SF2=\{(\mathrm{PERI})^2/\mathrm{AREA}\}\times(100\pi/4) \qquad \text{Equation 3,}$$

where "PERI" represents the perimeter of a figure obtained by projecting a toner particle on a two dimensional plane.

When the value of the shape factor "SF-2" is 100, the surface of the toner is even (i.e., no convex and concave portions). As the value of the "SF-2" increases, the surface of the toner becomes uneven (i.e., the number of convex and concave portions increase).

In this embodiment, toner images are sampled by using a field emission type scanning electron microscope (FE-SEM) S-800 manufactured by HITACHI, LTD. The toner image information is analyzed by using an image analyzer (LUSEX3) manufactured by NIREKO, LTD.

When a toner particle has a higher roundness, the toner particle is more likely to make a point-contact with another toner particle on a photoconductive element. In this case, the adhesion force between the toner particles is weak, thereby making the toner particles highly flowable. Also, while the weak adhesion force between the round toner particle and the photoconductive element enhances the transfer rate, the round toner is more likely to create a cleaning malfunction for the blade type cleaning mechanism. However, in this case, the lubricant supplying device 30, according to the exemplary embodiment, applies the lubricant onto the surface of the photoconductive element 5 by using the brush roller 15 to reduce the coefficient of friction on the surface of the photoconductive element 5 so that the toner particles can be easily removed. It is noted that large SF-1 and SF-2 values may deteriorate the visual quality of an image due to scattered toner particles on the image. It is preferable that the SF-1 and SF-2 values be less than 180.

Further, the toner used in the printer 1 may be substantially spherical.

Figure 7A:
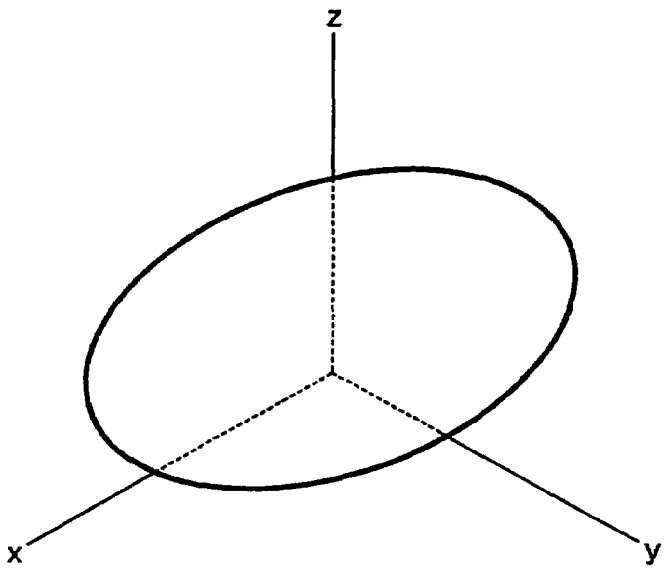
FIGS. 7A, 7B, and 7C show exemplary shapes of a toner particle according to an embodiment of the present invention.
Figure 7B:
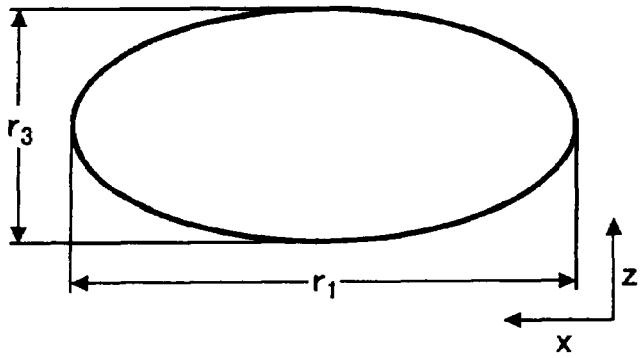
Figure 7C:
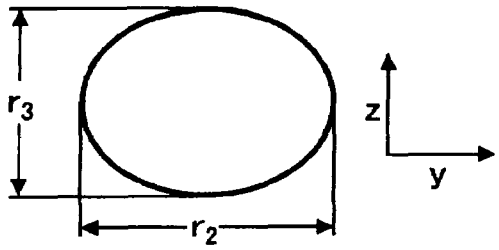

Referring to FIGS. 7A, 7B and 7C, sizes of the toner are described. An axis x of FIG. 7A represents a major axis r1 of FIG. 7B, which is the longest axis of the toner. An axis y of FIG. 7A represents a minor axis r2 of FIG. 7B, which is the second longest axis of the toner. The axis z of FIG. 7A represents a thickness r3 of FIG. 7B, which is a thickness of the shortest axis of the toner. The toner has a relationship between the major and minor axes r1 and r2 and the thickness r3 as follows:

$$r1 \geqq r2 \geqq r3.$$

The toner of FIG. 7A is preferably in a spindle shape in which the ratio (r2/r1) of the major axis r1 to the minor axis r2 is approximately 0.5 to approximately 0.8, and the ratio (r3/r2) of the thickness r3 to the minor axis is approximately 0.7 to approximately 1.0.

When the ratio (r2/r1) is less than approximately 0.5, the toner has an irregular particle shape, and the rates of the dot reproducibility and transfer efficiency may decrease, resulting in degraded image quality.

When the ratio (r3/r2) is less than approximately 0.7, the toner has an irregular particle shape, and the transferability may be degraded compared to transferability obtained with substantially spherical toner particles. When the ratio (r3/r2) is approximately 1.0, the toner has a substantially spherical shape, and the fluidity of toner may increase.

The lengths of r1, r2 and r3 can be monitored and measured, for example, with a color microscope VH-8500, manufactured by Keyence Corp., by uniformly dispersing toner on a flat and smooth measuring plate, and magnifying 100 particles of the toner by 500 times with the color laser microscope VH-8500.

The preferred toner for use in an image forming apparatus according to the present invention is produced through bridge reaction and/or elongation reaction of a liquid toner material in an aqueous solvent. Here, the liquid toner material is generated by dispersing polyester prepolymer including an aromatic group having at least a nitrogen atom, polyester, a coloring agent, and a release agent in organic solvent. In the following, toner constituents and a toner manufacturing method are described in detail.

(Polyester)

Polyester is produced by the condensation polymerization reaction of a polyhydric alcohol compound with a polyhydric carboxylic acid compound.

A polyalcohol (PO) compound may be divalent alcohol (DIO) and tri- or more valent polyalcohol (TO). Only DIO or a mixture of DIO and a small amount of TO is preferred. The divalent alcohol (DIO) may be alkylene glycol (ethylene glycol, 1,3-propylene glycol, 1,4-butanediol, 1,6-hexanediol or the like), alkylene ether glycol (diethylene glycol, triethylene glycol, dipropyrene glycol, polyethylene glycol, polypropylene glycol, polytetramethylene ether glycol or the like), alicyclic diol (1,4-cyclohexane dimethanol, hydrogenated bisphenol A or the like), bisphenols (bisphenol A, bisphenol F, bisphenol S or the like), alkylene oxide adducts of above-mentioned alicyclic diols (ethylene oxide, propylene oxide, butylene oxide or the like), and alkylene oxide adducts of the above-mentioned bisphenols (ethylene oxide, propylene oxide, butylene oxide or the like).

Alkylene glycol having 2-12 carbon atoms and alkylene oxide adducts of bisphenols are preferred. In particular, the alkylene glycol having 2-12 carbon atoms and the alkylene oxide adducts of bisphenols are preferably used together. Tri- or more valent polyalcohol (TO) may be tri- to octa or more valent polyaliphatic alcohols (glycerin, trimethylolethane, trimethylol propane, pentaerythritol, sorbitol or the like), tri- or more valent phenols (trisphenol PA, phenol novolac, cresol novolac or the like), and alkylene oxide adducts of tri- or more valent polyphenols.

The polycarboxylic acid (PC) may be divalent carboxylic acid (DIC) and tri- or more valent polycarboxylic acid (TC). Only DIC or a mixture of DIC and a small amount of TC is preferred. The divalent carboxylic acid (DIC) may be alkylene dicarboxylic acid (succinic acid, adipic acid, sebacic acid or the like), alkenylene dicarboxylic acid (maleic acid, fumaric acid or the like), and aromatic dicarboxylic acid (phthalic acid, isophthalic acid, terephthalic acid, naphthalene dicarboxylic acid or the like). Alkenylene dicarboxylic acid having 4-20 carbon atoms and aromatic dicarboxylic acid having 8-20 carbon atoms are preferred. Tri- or more valent polycarboxylic acid may be aromatic polycarboxylic acid having 9-20 carbon atoms (trimellitic acid, pyromellitic acid or the like). Here, the polycarboxylic acid (PC) may be reacted to the polyalcohol (PO) by using acid anhydrides or lower alkyl ester (methylester, ethylester, isopropylester or the like) of the above-mentioned materials.

A ratio of the polyalcohol (PO) and the polycarboxylic acid (PC) is normally set between 2/1 and 1/1 as an equivalent ratio [OH]/[COOH] of a hydroxyl group [OH] and a carboxyl group [COOH]. The ratio preferably ranges from 1.5/1 through 1/1. In particular, the ratio is preferably between 1.3/1 and 1.02/1.

In the condensation polymerization reaction of a polyhydric alcohol (PO) with a polyhydric carboxylic acid (PC), the polyhydric alcohol (PO) and the polyhydric carboxylic acid (PC) are heated to a temperature from 150° C. to 280° C. in the presence of a known esterification catalyst, e.g., tetrabutoxy titanate or dibutyltineoxide. The generated water is distilled off with pressure being lowered, if necessary, to obtain a polyester resin containing a hydroxyl group. The hydroxyl value of the polyester resin is preferably 5 or more while the acid value of polyester is usually between 1 and 30, and preferably between 5 and 20. When a polyester resin having such an acid value is used, the residual toner is easily negatively charged. In addition, the affinity of the toner for recording paper can be improved, resulting in improvement of low temperature fixability of the toner. However, a polyester resin with an acid value above 30 can adversely affect stable charging of the residual toner, particularly when the environmental conditions vary.

The weight-average molecular weight of the polyester resin is from 10,000 to 400,000, and more preferably from 20,000 to 200,000. A polyester resin with a weight-average molecular weight between 10,000 lowers the offset resistance of the residual toner while a polyester resin with a weight-average molecular weight above 400,000 lowers the temperature fixability.

A urea-modified polyester is preferably included in the toner in addition to unmodified polyester produced by the above-described condensation polymerization reaction. The urea-modified polyester is produced by reacting the carboxylic group or hydroxyl group at the terminal of a polyester obtained by the above-described condensation polymerization reaction with a polyisocyanate compound (PIC) to obtain polyester prepolymer (A) having an isocyanate group, and then reacting the prepolymer (A) with amines to crosslink and/or extend the molecular chain.

(Modified Polyester)

The toner of the present invention includes a modified polyester (i) as binder resins.

Modified polyester means a polyester in which there is a bonding group present other than an ester bond in the polyester resin and resinous principles having a different structure in the polyester resin are bonded by a bond like covalent bond and ion bond. Concretely, it means a polyester terminal that is modified by introducing a functional group like an isocyanate group that reacts with a carboxylic acid group, a hydroxyl group to a polyester terminal and then allowed to react with a compound containing active hydrogen.

Suitable modified polyesters (i) include reaction products of a polyester prepolymer (A) having an isocyanate group with an amine (B). The polyester prepolymer (A) can be formed from a reaction between a polyester having an active hydrogen atom, which polyester is formed by polycondensation between a polyol (PO) and a polycarboxylic acid (PC), and a polyisocyanate (PIC). Specific examples of the groups including the active hydrogen include a hydroxyl group (an alcoholic hydroxyl group and a phenolic hydroxyl group), an amino group, a carboxyl group, a mercapto group, etc. In particular, the alcoholic hydroxyl group is preferably used.

Specific examples of the polyisocyanate (PIC) include aliphatic polyisocyanate such as tetramethylenediisocyanate, hexamethylenediisocyanate and 2,6-diisocyanatemethylcaproate; alicyclic polyisocyanate such as isophoronediisocyanate and cyclohexylmethanediisocyanate; 10 aromatic diisocyanate such as tolylenedisocyanate and diphenylmethanediisocyanate; aroma aliphatic diisocyanate such as α α ά ά-tetramethylxylylenediisocyanate; isocyanurate; the above-mentioned polyisocyanate blocked with phenol derivatives, oxime and caprolactam; and their combinations.

The polyisocyanate (PIC) is mixed with a polyester such that the equivalent ratio ([NCO]/[OH]) between the isocyanate group [NCO] of the polyisocyanate (PIC) and the hydroxyl group [OH] of the polyester is typically from 5/1 to 1/1, preferably from 4/1 to 1.2/1 and more preferably from 2.5/1 to 1.5/1. When [NCO]/[OH] is greater than 5, low temperature fixability of the resultant toner deteriorates. When the molar ratio of [NCO] is less than 1, the urea content in the resultant modified polyester decreases and hot offset resistance of the resultant toner deteriorates.

The content of the constitutional unit obtained from a polyisocyanate (PIC) in the polyester prepolymer (A) is from 0.5% to 40% by weight, preferably from 1 to 30% by weight and more preferably from 2% to 20% by weight. When the content is less than 0.5% by weight, hot offset resistance of the resultant toner deteriorates and in addition the heat resistance and low temperature fixability of the toner also deteriorate. In contrast, when the content is greater than 40% by weight, low temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the urea-modified polyester decreases and hot offset resistance of the resultant toner deteriorates.

Specific examples of the amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diamino cyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan.

Specific examples of amino acid (B5) are aminopropionic acid and caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these compounds, diamines (B1) and mixtures in which a diamine is mixed with a small amount of a polyamine (B2) are preferably used.

The mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than 1/2, molecular weight of the urea-modified polyester decreases, resulting in deterioration of hot offset resistance of the resultant toner.

Suitable polyester resins for use in the toner of the present invention include a urea-modified polyesters (i). The urea-modified polyester (i) may include a urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the molar ratio of the urea bonding is less than 10%, hot offset resistance of the resultant toner deteriorates.

The urea modified polyester is produced by, for example, a one-shot method. Specifically, a polyhydric alcohol (PO) and a polyhydric carboxylic acid (PC) are heated to a temperature of 150° C. to 280° C. in the presence of the known esterification catalyst, e.g., tetrabutoxy titanate or dibutyltineoxide to be reacted. The resulting water is distilled off with pressure being lowered, if necessary, to obtain a polyester containing a hydroxyl group. Then, a polyisocyanate (PIC) is reacted with the polyester obtained above a temperature of from 40° C. to 140° C. to prepare a polyester prepolymer (A) having an isocyanate group. The prepolymer (A) is further reacted with an amine (B) at a temperature of from 0° C. to 140° C. to obtain a urea-modified polyester.

At the time of reacting the polyisocyanate (PIC) with a polyester and reacting the polyester prepolymer (A) with the amines (B), a solvent may be used, if necessary. Specific examples of the solvent include solvents inactive to the isocyanate (PIC), e.g., aromatic solvents such as toluene, xylene; ketones such as acetone, methyl ethyl ketone, methyl isobutyl ketone; esters such as ethyl acetate; amides such as dimethyl formamide, dimethyl acetatamide; and ethers such as tetrahydrofuran.

If necessary, a reaction terminator may be used for the cross-linking reaction and/or extension reaction of a polyester prepolymer (A) with an amine (B), to control the molecular weight of the resultant urea-modified polyester. Specific examples of the reaction terminators include a monoamine such as diethylamine, dibutylamine, butylamine, lauryl amine, and blocked substances thereof such as a ketimine compound.

The weight-average molecular weight of the urea-modified polyester is not less than 10,000, preferably from 20,000 to 10,000,000 and more preferably from 30,000 to 1,000,000. A molecular weight of less than 10,000 deteriorates the hot offset resisting property. The number-average molecular weight of the urea-modified polyester is not particularly limited when the after-mentioned unmodified polyester resin is used in combination. Namely, the weight-average molecular weight of the urea-modified polyester resins has priority over the number-average molecular weight thereof. However, when the urea-modified polyester is used alone, the number-average molecular weight is not greater than 20,000, preferably from 1,000 to 10,000, and more preferably from 2,000 to 8,000. When the number-average molecular weight is greater than 20,000, the low temperature fixability of the resultant toner deteriorates, and in addition the glossiness of full color images deteriorates.

In the present invention, not only the urea-modified polyester alone but also the unmodified polyester resin can be included with the urea-modified polyester. A combination thereof improves low temperature fixability of the resultant toner and glossiness of color images produced by the printer 1, thereby the combination is more preferable than using the urea-modified polyester alone. It is noted that the unmodified polyester may contain polyester modified by a chemical bond other than the urea bond.

It is preferable that the urea-modified polyester at least partially mixes with the unmodified polyester resin to improve the low temperature fixability and hot offset resistance of the resultant toner. Therefore, the urea-modified polyester preferably has a structure similar to that of the unmodified polyester resin.

A mixing ratio between the urea-modified polyester and polyester resin is from 20/80 to 5/95 by weight, preferably from 70/30 to 95/5 by weight, more preferably from 75/25 to 95/5 by weight, and even more preferably from 80/20 to 93/7 by weight. When the weight ratio of the urea-modified polyester is less than 5%, the hot offset resistance deteriorates, and in addition, it is difficult to impart a good combination of high temperature preservability and low temperature fixability of the toner.

The toner binder preferably has a glass transition temperature (Tg) of from 45° C. to 65° C., and preferably from 45° C. to 60° C. When the glass transition temperature is less than 45° C., the high temperature preservability of the toner deteriorates. When the glass transition temperature is higher than 65° C., the low temperature fixability deteriorates.

Since the urea-modified polyester can exist on the surfaces of the mother toner particles, the toner of the present invention has better high temperature preservability than conventional toners including a polyester resin as a binder resin even though the glass transition temperature is low.

(Colorant)

Suitable colorants for use in the toner of the present invention include known dyes and pigments. Specific examples of the colorants include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, 25 Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, LitholFast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

A content of the colorant in the toner is preferably from 1 to 15% by weight, and more preferably from 3 to 10% by weight, based on the total weight of the toner.

The colorants mentioned above for use in the present invention can be used as master batch pigments by being combined with a resin.

The examples of binder resins to be kneaded with the master batch or used in the preparation of the master batch are styrenes like polystyrene, poly-p-chlorostyrene, polyvinyl toluene and polymers of their substitutes, or copolymers of these with a vinyl compound, polymethyl metacrylate, polybutyl metacrylate, polyvinyl chloride, polyvinyl acetate, polyethylene, polypropylene, polyester, epoxy resins, epoxy polyol resins, polyurethane, polyamides, polyvinyl butyral, polyacrylic resins, rosin, modified rosin, terpene resins, aliphatic and alicyclic hydrocarbon resins, aromatic petroleum resins, chlorinated paraffins, paraffin wax etc. which can be used alone or in combination.

(Charge Controlling Agent)

Specific examples of the charge controlling agent include known charge controlling agents such as Nigrosine dyes, triphenylmethane dyes, metal complex dyes including chromium, chelate compounds of molybdic acid, Rhodaminedyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc. Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative) PR, COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc. Among these materials, materials negatively charging a toner are preferably used.

The content of the charge controlling agent is determined depending on the species of the binder resin used, whether or not an additive is added, the toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large a charge quantity. Consequently, the electrostatic force of a developing roller attracting the toner increases, resulting in deterioration of the fluidity of the toner and decrease of the image density of toner images.

(Releasing Agent)

A wax for use in the toner of the present invention as a releasing agent has a low melting point of from 50° C. to 120° C. When such a wax is included in the toner, the wax is dispersed in the binder resin and serves as a releasing agent at a location between a fixing roller and the toner particles. Thereby, hot offset resistance can be improved without applying an oil to the fixing roller used. Specific examples of the releasing agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. In addition, fatty acid amides such as 1,2-hydroxylstearic acid amide, stearic acid amide and phthalic anhydride imide; and low molecular weight crystalline polymers such as acrylic homopolymer and copolymers having a long alkyl group in their side chain, e.g., poly-n-stearyl methacrylate, poly-n-laurylmethacrylate and n-stearyl acrylate-ethyl methacrylate copolymers, can also be used.

These charge controlling agents and releasing agents can be dissolved and dispersed after being kneaded and receiving an application of heat together with a master batch pigment and a binder resin; and can be added when directly dissolved and dispersed in an organic solvent.

(External Additives)

The inorganic particulate material preferably has a primary particle diameter of from $5\times10^{-3}$ to 2 μm, and more preferably from $5\times10^{-3}$ to 0.5 μm. In addition, a specific surface area of the inorganic particulates measured by a BET method is preferably from 20 to 500 $m^2/g$. The content of the external additive is preferably from 0.01 to 5% by weight, and more preferably from 0.01 to 2.0% by weight, based on total weight of the toner.

The inorganic particulate material preferably has a primary particle diameter of from $5\times10^{-3}$ to 2 μm, and more preferably from $5\times10^{-3}$ to 0.5 μm. In addition, a specific surface area of the inorganic particulates measured by the BET method is preferably from 20 to 500 $m^2/g$. The content of the external additive is preferably from 0.01 to 5% by weight, and more preferably from 0.01 to 2.0% by weight, based on total weight of the toner.

Specific examples of the inorganic fine grains are silica, alumina, titanium oxide, barium titanate, magnesium titanate, calcium tiatanate, strontium titanate, zinc oxide, tin oxide, quartz sand, clay, mica, wollastonite, diatomaceous earth, chromium oxide, cerium oxide, red oxide, antimony trioxide, magnesium oxide, zirconium oxide, barium sulfate, barium carbonate, calcium carbonate, silicon carbide, and silicon nitride. Among them, as a fluidity imparting agent, it is preferable to use hydrophobic silica fine grains and hydrophobic titanium oxide fine grains in combination.

Particularly, when two kinds of fine grains, having a mean grain size of $5\times10^{-2}$ μm or below, are mixed together, there can be a noticeable improvement of electrostatic force and van del Waals force with the toner. Therefore, despite the extra steps effected in the developing device for implementing the desired charge level, the fluidity imparting agent does not part from the toner grains and insures desirable image quality free from spots or similar image defects. In addition, the amount of residual toner can be reduced.

Titanium oxide fine grains are desirable for environmental stability and image density stability, but tend to have lower charge start characteristics. Therefore, if the amount of titanium oxide fine particles is larger than the amount of silica fine grains, then the influence of the above described side effect increases. However, so long as the amount of hydrophobic silica fine grains and hydrophobic titanium oxide fine grains is between 0.3 wt. % and 1.5 wt. %, the charge start characteristics are not noticeably impaired, i.e., desired charge start characteristics are achievable. Consequently, stable image quality is achievable despite repeated copying operations.

The toner of the present invention is produced by the following method, but the manufacturing method is not limited thereto.

(Preparation of Toner)

First, a colorant, unmodified polyester, polyester prepolymer having isocyanate groups and a parting agent are dispersed into an organic solvent to prepare a toner material liquid.

The organic solvent should preferably be volatile and have a boiling point of 100° C. or below because such a solvent is easy to remove after the formation of the toner mother particles. More specific examples of the organic solvent includes one or more of toluene, xylene, benzene, carbon tetrachloride, methylene chloride, 1,2-dichloroethane, 1,1,2-trichloroethane, trichloro ethylene, chloroform, monochlorobenzene, dichloroethylidene, methyl acetate, ethyl acetate, methyl ethyl ketone, methyl isobutyl ketone, and so forth. Particularly, the aromatic solvent such as toluene and xylene; and a hydrocarbon halide such as methylene chloride, 1,2-dichloroethane, chloroform or carbon tetrachloride is preferably used. The amount of the organic solvent to be used should preferably be 0 parts by weight to 300 parts by weight for 100 parts by weight of polyester prepolymer, more preferably be 0 parts by weight to 100 parts by weight for 100 parts by weight of polyester prepolymer, and even more preferably 25 parts by weight to 70 parts by weight for 100 parts by weight of polyester prepolymer.

The toner material liquid is emulsified in an aqueous medium in the presence of a surfactant and organic fine particles.

The aqueous medium for use in the present invention is water alone or a mixture of water with a solvent which can be mixed with water. Specific examples of such a solvent include alcohols (e.g., methanol, isopropyl alcohol and ethylene glycol), dimethylformamide, tetrahydrofuran, cellosolves (e.g., methyl cellosolve), lower ketones (e.g., acetone and methyl ethyl ketone), etc.

The content of the aqueous medium is typically from 50 to 2,000 parts by weight, and preferably from 100 to 1,000 parts by weight, per 100 parts by weight of the toner constituents. When the content is less than 50 parts by weight, the dispersion of the toner constituents in the aqueous medium is not satisfactory, and thereby the resultant mother toner particles do not have a desired particle diameter. In contrast, when the content is greater than 2,000, the manufacturing costs increase.

Various dispersants are used to emulsify and disperse an oil phase in an aqueous liquid including water in which the toner constituents are dispersed. Specific examples of such dispersants include surfactants, resin fine-particle dispersants, etc.

Specific examples of the dispersants include anionic surfactants such as alkylbenzenesulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethylammonium salts, dialkyldimethylammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycine, di(octylaminoethyle)glycine, and N-alkyl-N,N-dimethylammonium betaine.

A surfactant having a fluoroalkyl group can prepare a dispersion having good dispersability even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium, 3-lomega-fluoroalkanoyl(C6-C8)-N-ethylamino}-1-propanesulfonate, fluoroalkyl(C11-C20) carboxylic acids and their metal salts, perfluoroalkylcarboxylic acids (7C-13C) and their metal salts, perfluoroalkyl(C4-C12) sulfonate and their metal salts, perfluorooctanesulfonic acid diethanol amides, N-propyl-N-(2-hydroxyethyl-)perfluorooctanesulfone amide, perfluoroalkyl(C6-C10) sulfoneamidepropyltrimethylammonium salts, salts of perfluoroalkyl (C6-C10)-N-ethylsulfonylglycin, monoperfluoroalkyl(C6-C16)ethylphosphates, etc.

Specific examples of the marketed products of such surfactants having a fluoroalkyl group include SARFRON® S-111, S-112 and S-113, which are manufactured by ASAHI GLASS CO., LTD.; FLUORAD® FC-93, FC-95, FC-98 and FC-129, which are manufactured by SUMITOMO 3M LTD.; UNIDYNE® DS-101 and DS-102, which are manufactured by DAIKIN INDUSTRIES, LTD.; MEGAFACE® F-110, F-120, F-113, F-191, F-812 and F-833 which are manufactured by DAINIPPON INK AND CHEMICALS, INC.; ECTOP EF-102, 103, 104, 105, 112, 123A, 123B, 306A, 501, 201 and 204, which are manufactured by TOHCHEM PRODUCTS CO., LTD.; FUTARGENT® F-100 and F150 manufactured by NEOS; etc.

Specific examples of the cationic surfactants, which can disperse an oil phase including toner constituents in water, include primary, secondary and tertiary aliphatic amines having a fluoroalkyl group, aliphatic quaternary ammonium salts such as perfluoroalkyl(C6-C10)sulfone-amidepropyltrimethylammonium salts, benzalkonium salts, benzetonium chloride, pyridinium salts, imidazolinium salts, etc. Specific examples of the marketed products thereof include SARFRON® S-121 (manufactured by ASAHI GLASS CO., LTD.); FLUORAD® FC-135 (manufactured by SUMITOMO 3M LTD.); UNIDYNE DS-202 (manufactured by DAIKIN INDUSTRIES, LTD.); MEGAFACE® F-150 and F-824 (manufactured by DAINIPPON INK AND CHEMICALS, INC.); ECTOP EF-132 (manufactured by TOHCHEM PRODUCTS CO., LTD.); FUTARGENT® F-300 (manufactured by NEOS); etc.

The resin constituting the fine polymer particles can be any known resin, as long as it can form an aqueous dispersion, and can be either a thermoplastic resin or a thermosetting resin. Specific examples of such resins are vinyl resins, polyurethane resins, epoxy resins, polyester resins, polyamide resins, polyimide resins, silicone resins, phenolic resins, melamine resins, urea resins, aniline resins, ionomer resins, and polycarbonate resins. Each of these resins can be used alone or in combination.

Among them, vinyl resins, polyurethane resins, epoxy resins, polyester resins, and mixtures of these resins are preferred for easily preparing an aqueous dispersion of fine spherical polymer particles.

Examples of the vinyl resins are homopolymers or copolymers of vinyl monomers, such as styrene-acrylic ester resins, styrene-methacrylic ester resins, styrene-butadiene copolymers, acrylic acid-acrylic ester copolymers, methacrylic acid-acrylic ester copolymers, styrene-acrylonitrile copolymers, styrene-maleic anhydride copolymers, styrene-acrylic acid copolymers and styrene-methacrylic acid copolymers. An average particle diameter of the resin constituting the fine polymer particles is preferably from approximately 5 nm to approximately 200 nm, and more preferably from approximately 20 nm to approximately 300 nm.

Resin fine particles are added to stabilize toner source particles formed in the aqueous solvent. The resin fine particles are preferably added such that the coverage ratio thereof on the surface of a toner source particle can be within 10% through 90%. For example, such resin fine particles may be methyl polymethacrylate particles of 1 μm and 3 μm, polystyrene particles of 0.5 μm and 2 μm, poly(styrene-acrylonitrile)particles of 1 μm, commercially, PB-200 (manufactured by KAO Co.), SGP, SGP-3G (manufactured by SOKEN), technopolymer SB (manufactured by SEKISUI PLASTICS CO., LTD.), micropearl (manufactured by SEKISUI CHEMICAL CO., LTD.) or the like.

Also, an inorganic dispersant such as calcium triphosphate, calcium carbonate, titanium oxide, colloidal silica, and hydroxyapatite may be used.

Further, it is possible to stably disperse toner constituents in water using a polymeric protection colloid in combination with the inorganic dispersants and/or particulate polymers mentioned above. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, (β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g., acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethyleneimine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethylcellulose and hydroxypropylcellulose, can also be used as the polymeric protective colloid.

The dispersion method is not particularly limited, and conventional dispersion facilities, e.g., low speed shearing type, high speed shearing type, friction type, high pressure jet type and ultrasonic type dispersers can be used. Among them, the high speed shearing type dispersion methods are preferable for preparing a dispersion including grains with a grain size of 2 to 20 μm. The number of rotations of the high speed shearing type dispersers is not particularly limited, but is usually 1,000 rpm (revolutions per minute) to 30,000 rpm, and preferably 5,000 to 20,000 rpm. While the dispersion time is not limited, it is usually 0.1 to 5 minutes for the batch system. The dispersion temperature is usually 0° C. to 150° C., and preferably 40 to 98° C. under a pressurized condition.

At the same time as the production of the emulsion, an amine (B) is added to the emulsion to be reacted with the polyester prepolymer (A) having isocyanate groups.

The reaction causes the crosslinking and/or extension of the molecular chains to occur. The elongation and/or crosslinking reaction time is determined depending on the reactivity of the isocyanate structure of the prepolymer (A) and amine (B) used, but is typically from 10 min to 40 hrs, and preferably from 2 to 24 hrs. The reaction temperature is typically from 0 to 150° C., and preferably from 40 to 98° C. In addition, a known catalyst such as dibutyltinlaurate and dioctyltinlaurate can be used. The amines (B) are used as the elongation agent and/or crosslinker.

After the above reaction, the organic solvent is removed from the emulsion (reaction product), and the resultant particles are washed and then dried. Thus, mother toner particles are prepared.

To remove the organic solvent, the entire system is gradually heated in a laminar-flow agitating state. In this case, when the system is strongly agitated in a preselected temperature range, and then subjected to a solvent removal treatment, fusiform mother toner particles can be produced. Alternatively, when a dispersion stabilizer, e.g., calcium phosphate, which is soluble in acid or alkali, is used, calcium phosphate is preferably removed from the toner mother particles by being dissolved by hydrochloric acid or similar acid, followed by washing with water. Further, such a dispersion stabilizer can be removed by a decomposition method using an enzyme.

Then a charge controlling agent is penetrated into the mother toner particles, and inorganic fine particles such as silica, titanium oxide etc. are added externally thereto to obtain the toner of the present invention.

In accordance with a well-known method, for example, a method using a mixer, the charge controlling agent is provided, and the inorganic particles are added.

Thus, a toner having a small particle size and a sharp particle size distribution can be obtained easily. Moreover, by controlling the stirring conditions when removing the organic solvent, the particle shape of the particles can be controlled so as to be any shape between perfectly spherical and rugby ball shape. Furthermore, the conditions of the surface can also be controlled so as to be any condition from a smooth surface to a rough surface such as the surface of pickled plum.

The above-described embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

The invention claimed is:

1. A molded lubricant for application to an image bearing member included in an image forming apparatus, the molded lubricant comprising:

a resin material to cause the molded lubricant to have a Martens hardness of about 40 $N/mm^2$ to about 70 $N/mm^2$ measured with a test force of 50 mN and a load-applying period of 30 seconds.

2. The molded lubricant according to claim 1, wherein the resin material includes a metal salt of a fatty acid.

3. The molded lubricant according to claim 1, wherein the resin material includes zinc stearate.

4. A process cartridge detachably attached with respect to an image forming apparatus, comprising:

an image bearing member configured to bear an image;

a cleaning device configured to clean a surface of the image bearing member; and a lubricant supplying device including, a molded lubricant including a resin material to cause the molded lubricant to have a Martens hardness of about 40 $N/mm^2$ to about 70 $N/mm^2$ measured with a test force of 50 mN and a load-applying period of 30 seconds.

5. The process cartridge according to claim 4, wherein the resin material of the molded lubricant includes a metal salt of a fatty acid.

6. The process cartridge according to claim 4, wherein the resin material includes zinc stearate.

7. The process cartridge according to claim 4, wherein the lubricant supplying device further comprises:

a rotative member having a fibrous brush of a thickness of about 5 deniers to about 15 deniers in a circumference of a rotative supporting axis thereof, and a density of about 20,000 fibers to about 100,000 fibers per square inch, and configured to apply lubricant shavings of the molded lubricant to the image bearing member held in contact with the cleaning member and to remove the lubricant shavings remaining on the surface of the image bearing member; and a pressing member configured to press the molded lubricant against the rotative member at a pressure force in a range from about 2 N/m to about 12 N/m.

8. The process cartridge according to claim 7, wherein the rotative member includes an insulative material.

9. The process cartridge according to claim 7, wherein a ratio of a circumferential velocity of the rotative member with respect to the image bearing member is in a range of about 0.8 to about 1.2.

10. The process cartridge according to claim 7, wherein (a) either a contact portion of the molded lubricant or the rotative member includes a corner portion of the molded lubricant and (b) a surface of the molded lubricant at the contact portion with respect to the rotative member is removed before the molded lubricant is mounted on the lubricant supplying device.

11. An image forming apparatus, comprising:

an image bearing member configured to bear an image;

a cleaning device configured to clean a surface of the image bearing member; and a lubricant supplying device, including, a molded lubricant including a resin material to cause the molded lubricant to have Martens hardness of about 40 $N/mm^2$ to about 70 $N/mm^2$ measured with a test force of 50 mN and a load-applying period of 30 seconds.

12. The image forming apparatus according to claim 11, wherein the resin material of the molded lubricant includes a metal salt of a fatty acid.

13. The image forming apparatus according to claim 11, wherein the resin material includes zinc stearate.

14. The image forming apparatus according to claim 11, wherein the lubricant supplying device further comprises:

a rotative member having a fibrous brush of a thickness of about 5 deniers to about 15 deniers in a circumference of a rotative supporting axis thereof, a density of about 20,000 fibers to about 100,000 fibers per square inch, and configured to apply lubricant shavings of the molded lubricant to the image bearing member held in contact with the cleaning member and to remove the lubricant shavings remaining on the surface of the image bearing member; and a pressing member configured to press the molded lubricant against the rotative member at a pressure force in a range from about 2 N/m to about 12 N/m.

15. The image forming apparatus according the claim 14, wherein the rotative member includes an insulative material.

16. The image forming apparatus according to claim 14, wherein a ratio of a circumferential velocity of the rotative member with respect to the image bearing member is in a range of about 0.8 to about 1.2.

17. An image forming apparatus according to claim 14, wherein (a) either a contact portion of the molded lubricant or the rotative member includes a corner portion of the molded lubricant and (b) a surface of the molded lubricant at the contact portion with respect to the rotative member is removed before the molded lubricant is mounted on the lubricant supplying device.

18. The image forming apparatus according to claim 11, wherein the image bearing member, the cleaning device, and the lubricant supplying device are integrally assembled in a process cartridge.

* * * * *